United States Patent [19]

Kurokawa et al.

[11] Patent Number: 5,040,013

[45] Date of Patent: Aug. 13, 1991

[54] PHOTOSENSITIVE MATERIAL PROCESSING APPARATUS

[75] Inventors: Toshio Kurokawa, Odawara; Takashi Nakamura, Minami-ashigara, both of Japan

[73] Assignee: Fuji Photo Film Co., Ltd., Kanagawa, Japan

[21] Appl. No.: 502,888

[22] Filed: Apr. 2, 1990

[30] Foreign Application Priority Data

| | | | |
|---|---|---|---|
| Apr. 10, 1989 | [JP] | Japan | 1-090422 |
| Aug. 21, 1989 | [JP] | Japan | 1-214561 |
| Aug. 21, 1989 | [JP] | Japan | 1-214562 |
| Aug. 28, 1989 | [JP] | Japan | 1-221270 |

[51] Int. Cl.[5] ..... G03D 3/02; G03D 3/08

[52] U.S. Cl. ..... 354/322; 354/324

[58] Field of Search ..... 354/320, 321, 322, 324

[56] References Cited

U.S. PATENT DOCUMENTS

| | | | |
|---|---|---|---|
| 4,166,689 | 9/1979 | Schausberger et al. | 354/321 |
| 4,710,009 | 12/1987 | Schneider | 354/324 X |

FOREIGN PATENT DOCUMENTS

| | | | |
|---|---|---|---|
| 1522876 | 10/1969 | Fed. Rep. of Germany | 354/320 |
| 62-326075 | 12/1987 | Japan | 354/331 |

*Primary Examiner*—A. A. Mathews

*Attorney, Agent, or Firm*—Sughrue, Mion, Zinn, Macpeak & Seas

[57] ABSTRACT

A space-saving, efficient wash tank is provided in which a plurality of compartments are serially connected through narrow channels to provide a continuous processing path, and wash water is supplied to the path through a selected compartment, whereby a strip of photosensitive material is washed with the water during its passage through the path. This wash tank ensures efficient washing and water saving when the selected compartment has a smaller volume than the remaining compartments or when the selected compartment is substantially emptied of the water during a quiescent period, or bath. Wash water flows in counter flow to the travel direction of photosensitive material during operation and is drained from the lowermost compartment at the end of operation.

22 Claims, 13 Drawing Sheets

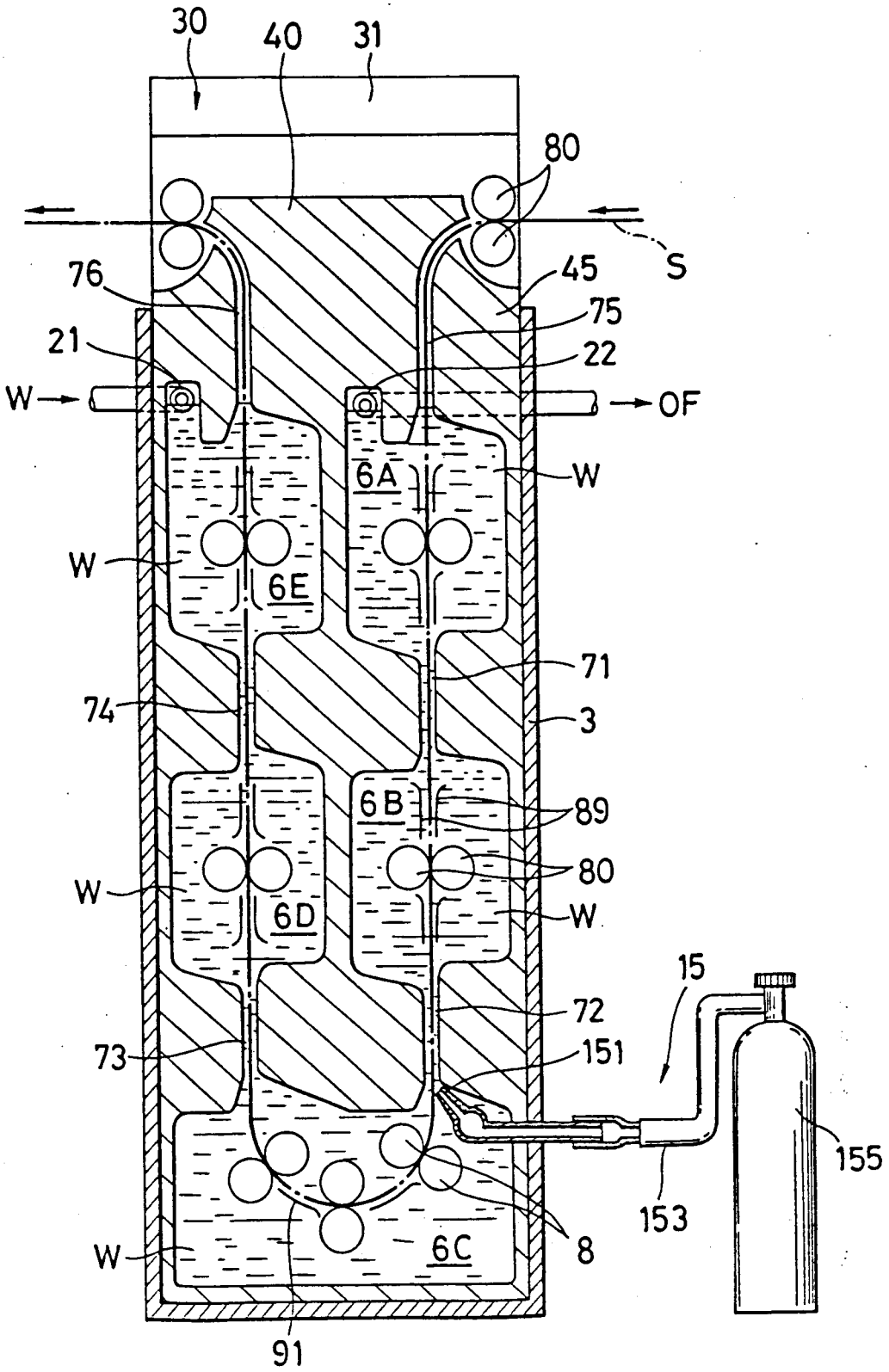
30
40
31
80
S
76
45
75
21
22
W
OF
6A
W
W
6E
71
74
3
6B
89
80
W
6D
W
15
72
73
151
155
153
8
W
6C
91

PHOTOSENSITIVE MATERIAL PROCESSING APPARATUS

CROSS REFERENCE TO THE RELATED APPLICATION

This application is related to copending application Ser. No. 340,820 filed Apr. 20, 1989, for "Method and Apparatus for Processing Photosensitive Material" by Nakamura and Kurokawa, which is incorporated herein by reference.

BACKGROUND OF THE INVENTION

This invention relates to an apparatus for processing photosensitive material, particularly silver halide photosensitive material.

In general, silver halide photosensitive material (simply referred to as photosensitive material) after exposure is subjected to a series of wet processing steps including development, desilvering, washing, and stabilization. The development step uses a developer, the desilvering uses bleaching, bleach-fixing and fixing solutions, the washing uses city water or deionized water, and the stabilization uses a stabilizing solution. These solutions are generally adjusted to a temperature of 30° C. to 40° C. Photosensitive material is successively dipped in the solutions for the respective processing purposes. Such a series of processing steps are most often carried out by means of an automatic processor by successively transferring the photosensitive material through processing tanks filled with the respective solutions.

The recent general demands for environmental protection and resource saving are also imposed to this type of processing. It is thus desired to save processing solutions, particularly wash water. A saving of wash water can be accomplished by increasing washing efficiency. It is known that an increased washing efficiency can be achieved by providing a plurality of washing tanks filled with wash water. One approach for achieving an increased washing efficiency with a less amount of water is a multi-stage counterflow washing mode which generally employs 2 to 9 stages. Since a plurality of wash tanks are arranged in a side-by-side relationship, the counterflow processing system is increased in size, requiring a substantial space for installation. The prior art apparatus were insufficient in saving the amount of wash water loaded and replenished.

In copending application Ser. No. 340,820 filed Apr. 20, 1989, or Japanese Patent Application No. 27034/1989 for "Method and Apparatus for Processing Photosensitive Material," the inventors proposed an apparatus for wet processing a photosensitive material, comprising a processing tank for defining an interior chamber, means for partitioning the tank chamber into a plurality of serially arranged compartments, the compartments being connected through narrow channels and filled with processing solution, and means for successively passing the photosensitive material through the compartments. This apparatus is reduced in size and successful in reducing the amount of wash water used because of increased washing efficiency. More particularly, since the compartments are connected for fluid communication through narrow channels, the degree of contamination of wash water varies among the compartments in the flow direction of wash water. Since the photosensitive material is transferred in a direction opposite to the flow direction of wash water, the material is washed with gradually cleaner wash water, leading to an increased washing efficiency.

If such operation is to be interrupted for a certain period of time, particularly in the case of water washing, it is desired to drain more or less contaminated wash water from the tank, keep the tank empty during the quiescent period, and fill the tank with fresh water again at the start of next operation. However, this drainage operation is cumbersome. Particularly when the quiescent period is not so long, the complete drainage of the wash water seems to be against the general purpose of saving wash water. If wash water is left in the apparatus, the wash waters in the respective compartments intermix during the quiescent period so that the wash waters are contaminated to an approximately equal level. Then it is difficult to accomplish efficient washing immediately after the restart of operation. A similar problem occurs with other processing solutions used in development, bleaching, bleach-fixation, and fixation.

Another problem arises with water washing through a continuous processing path comprising compartments connected through narrow channels. As in the prior art apparatus, when photosensitive material is transferred from the preceding stage tank (e.g., bleach-fixing or fixing tank) to the wash tank, the processing solution of the preceding stage tank adheres to the emulsion surface of the photosensitive material to form a thin solution layer thereon so that a double layer is created at the interface. This solution layer is obstructive to wash away chemicals present on or in the emulsion layer. Insufficient washing away of chemicals would eventually cause discoloration, fading, stain formation in prints during storage, and sticking between stacked prints. Also film properties are insufficient.

The above-mentioned problem caused by a thin solution layer adhering to the photosensitive material commonly occurs in any processing tanks into which the preceding solution is carried by the photosensitive material, resulting in insufficient photographic properties.

The developing tank which is the first tank in the process is free of the problem of adherence of a thin layer of the entraining solution. Nevertheless, the processing or reaction in a first compartment creates unnecessary or exhausted products which will adhere to the photosensitive material to form a double layer with an overlying thin layer of the first compartment solution. The thin layer of first compartment solution and the double layer are entrained into a second compartment. This results in less efficient processing.

It has become practical to recycle wash water. It is known to use ion-exchange resins as disclosed in J. Appl. Phot. Eng., 6, 120 (1980) and ibid., 5, 141 (1979) and reverse osmosis units as disclosed in USSR Patent No. 701963. Further, Japanese Patent Unexamined Publication (JP-A) No. 105150/1983 discloses the reuse of wash water by passing used wash water through a reverse osmosis unit where the wash water is separated into dilute and concentrate portions, and feeding the concentrate and dilute portions back to the bleach-fixing and washing tanks, respectively. The recycle of wash water through a reverse osmosis unit can achieve a saving of wash water when applied to a conventional wash tank. Since a great volume of wash water is subjected to reverse osmosis, however, the load of the reverse osmosis unit must be large enough. Then the unit is increased in size.

SUMMARY OF THE INVENTION

A primary object of the present invention is to provide a novel and improved photosensitive material processing apparatus capable of efficient processing with a reduced amount of processing solution.

A second object of the present invention is to provide a photosensitive material processing apparatus which after interruption, can restart its operation at high efficiency in a simple manner.

A third object of the present invention is to provide a photosensitive material processing apparatus adapted for water washing which after interruption, can restart washing at high efficiency in a simple manner.

A fourth object of the present invention is to provide a photosensitive material processing apparatus which can save the amount of processing solution, typically wash water, while achieving efficient processing.

Briefly stated, the present invention pertains to an apparatus for processing a silver halide photosensitive material, comprising a processing tank defining a plurality of compartments serially connected through narrow channels to provide a continuous processing path, means for supplying a processing solution to the path through a selected compartment such that the path is filled with the solution, and means for passing the photosensitive material through the path whereby the photosensitive material is processed with the solution.

In a first form of the invention, the selected compartment to which the processing solution is first supplied (often referred to as the first compartment) has a smaller volume than the remaining compartments.

In a second form of the invention, the selected compartment to which the processing solution is first supplied is substantially emptied of the processing solution during a quiescent period.

Most often, the apparatus is a wash tank in which the processing solution in the form of wash water flows in counter flow relationship with respect to the travel direction of photosensitive material.

In a third form of the invention, the apparatus further includes a sump in fluid communication with a lower compartment which is located at a vertically lower position of the continuous processing path, preferably the lowermost compartment. There is provided means for restraining the fluid communication between said sump and said lower compartment during processing, but allowing the fluid communication between said sump and said lower compartment at the end of processing such that a desired portion of the wash water is drained from said path to said sump.

In a fourth form of the invention, the apparatus further includes a recycle system including means for taking an exhausted portion of the wash water out of the continuous processing path, means for separating the water into dilute and concentrate portions, and means for feeding the dilute portion back to the path to join the counter flow of wash water. The dilute and concentrate are used in connection with chemical compounds which are carried into the wash water during operation.

In a fifth form of the invention, the apparatus further includes means for delivering bubbles of an inert gas to the photosensitive material in a counter flow with respect to the travel direction of the photosensitive material.

BENEFITS OF THE INVENTION

Since a plurality of compartments are serially connected through narrow channels, differential concentrations in composition of the processing solution are maintained in accordance with the flow direction of the processing solution, ensuring a high processing efficiency.

In the first form wherein the first compartment has a smaller volume than the remaining compartments, when it is desired to restart replenishment of processing solution after a quiescent period, the solution in the smaller volume compartment is immediately displaced by fresh solution. High processing efficiency is expectable from the beginning of resumed operation after the quiescent period.

In the second form wherein the first compartment is substantially emptied of the processing solution during a quiescent period, the processing operation can be restarted simply by refilling the empty compartment with fresh solution. High processing efficiency is expectable from the beginning of resumed operation after the quiescent period. It is possible to empty the first compartment such that the most exhausted portion of the processing solution is also drained at the same time.

In the third form of the invention, the sump is in fluid communication with the lower, preferably lowermost, compartment, and the communication control means allows the fluid communication between the sump and the lower compartment at the end of processing or during a quiescent period until a predetermined volume of wash water is drained to the sump. With a proper choice of control timing, a most exhausted portion of the wash water can be drained.

In the fourth form, when the photosensitive material after exposure is processed in the order of development, bleach-fixation, and washing, at least wash water is charged in a wash tank having a plurality of compartments. Preferably a developer and a bleach-fixing solution are also charged in such tanks each having a plurality of compartments. The photosensitive material is sequentially passed through the developing, bleach-fixing, and washing tanks. An exhausted portion of the wash water is separated into dilute and concentrate water portions by the separator means. The dilute portion or relatively pure water is fed back to the wash tank to join the counter flow of wash water. An increase of washing efficiency and a saving of wash water are expectable.

In the fifth form of the invention, a thin layer of the preceding tank solution adhering to the emulsion surface of photosensitive material and a double layer including the thin solution layer and unnecessary reaction products are removed by bubbling an inert gas to the photosensitive material in a counter flow with respect to the travel direction of the photosensitive material. This facilitates the washing away of unnecessary substances from the photosensitive material surface. Washing efficiency is accordingly increased. Essentially, an increase of processing (or washing) efficiency and a resultant saving of processing solution (or wash water) are attributable to the structural feature of the processing tank of the invention that a plurality of compartments are serially connected through narrow channels to define a continuous processing path so that differential concentrations in composition of the processing solution are maintained in accordance with the flow direction of the processing solution. The injection of inert gas bubbles against the photosensitive material not only prevents the undesired movement of wash water induced by the photosensitive material in its travel direction, but also assists more fresh wash water in moving along the path in an opposite direction to the travel direction of photosensitive material. As a result, the differential concentrations are maintained more definite in the preferred direction. The advantages resulting from removal of a thin solution layer or a double layer, which have been discussed in connection with a wash tank, are commonly obtained in processing tanks in which a carry-in of processing solution from the preceding tank causes a problem. Even in the case of a developing tank which is a first tank in the continuous process, processing efficiency is increased because unnecessary or exhausted substances tending to adhere to the photosensitive material are removed by bubbling. These advantages are unique and inherent to the processing tank wherein compartments are sequentially connected through narrow channels. Within the confine of narrow channels, a thin layer of the preceding stage solution or a double layer is readily broken and removed by inert gas bubbles moving in an opposite direction to the travel direction of photosensitive material.

BRIEF DESCRIPTION OF THE DRAWINGS

The above and other objects, features and advantages of the present invention will be better understood from the following description taken in conjunction with the accompanying drawings, in which:

FIG. 13 is a vertical cross section of a wash tank according to a fifth embodiment of the invention, showing a gas bubble injection nozzle.

In the figures, like numerals designate like parts.

DESCRIPTION OF THE PREFERRED EMBODIMENTS

The photosensitive material to be processed in the apparatus of the invention is a silver halide photosensitive material which generally takes the form of a web, strip or sheet. The processing solution is used in the present invention in a broader sense as encompassing a wide variety of fluid ranging from wash liquid as typified by water to ordinary processing solutions in a common sense in the photographic art, typically developing and bleach-fix solutions. More particularly, the ordinary processing solutions which can be used in the apparatus of the present invention include developing, fixing, bleaching, bleach-fix, and reversing solutions as well as water.

Figure 1:
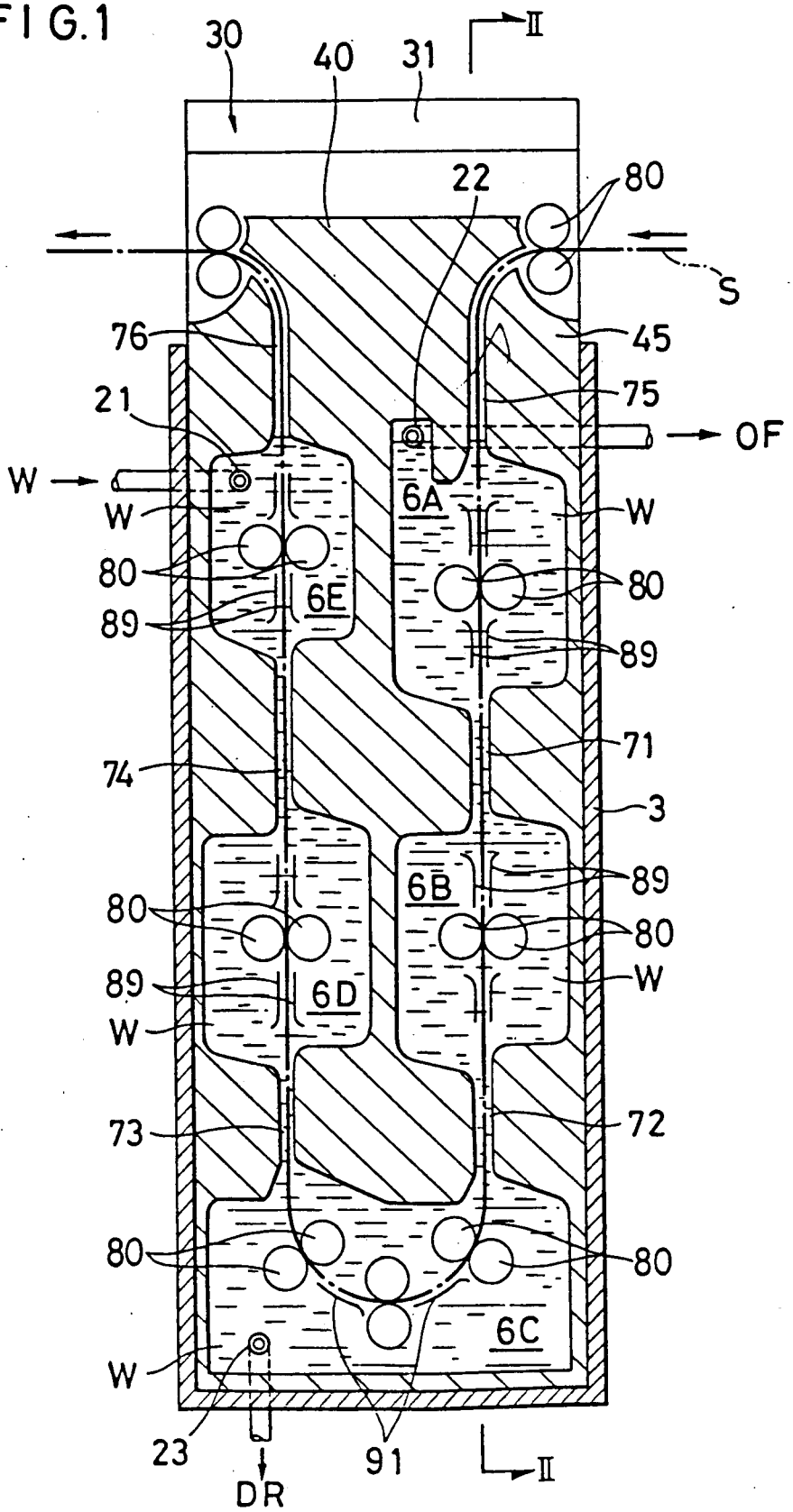
FIG. 1 is a vertical cross section of a wash tank according to a first embodiment of the present invention.
Figure 2:
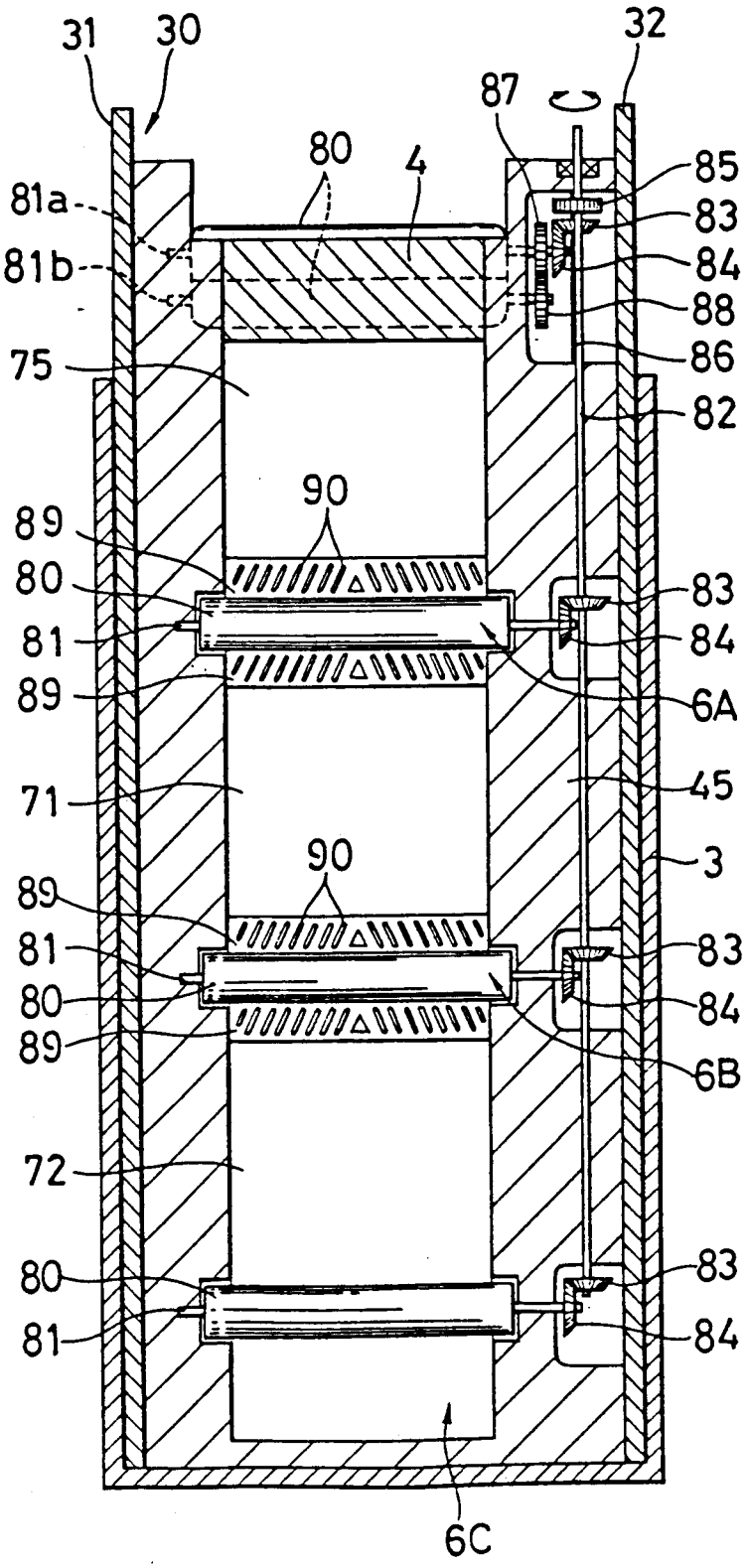
FIG. 2 is a cross section taken along lines II—II in FIG. 1.

FIGS. 1 and 2 illustrate a wash tank as a typical example of the processing apparatus in the first form of the present invention.

The processing apparatus is illustrated as comprising a vertical elongated housing or tank 3 and a rack assembly 30 accommodated therein. The rack assembly 30 includes a pair of side plates 31 and 32 and blocks 40 and 45 mounted therebetween.

The central block 40 is disposed inside the outer block 45. The blocks 40 and 45 are configured such that when placed in register as shown in FIG. 1, five serially arranged compartments 6A, 6B, 6C, 6D and 6E are defined therebetween for processing, that is, washing in this embodiment, a photosensitive material in the form of a photosensitive strip S. The blocks 40 and 45 placed in register also define narrow channels 71, 72, 73 and 74 between two adjoining compartments 6A and 6B, 6B and 6C, 6C and 6D, and 6D and 6E for fluid communication and strip passage therebetween. A continuous washing (or processing) path is thus defined in the tank for both the wash water (or processing solution) and the photosensitive material. The blocks 40 and 45 further define similar narrow first and last channels 75 and 76 above the compartments 6A and 6E for carrying the photosensitive strip S into and out of the tank or wash water. For brevity of description, the compartment 6A where the photosensitive material enters the tank is sometimes designated an entrance compartment, and the compartment 6E where the photosensitive material exits the tank is sometimes designated an exit compartment.

The blocks 40 and 45 are solid members in the illustrated embodiment, but may be hollow members which can be blow molded, for example. The blocks 40 and 45 may be formed of a resin or other material as long as they can be molded or machined to a relatively complex configuration as shown in the figures. They are usually formed of a hard material which is durable, undergoes no deformation, expansion or weakening under the action of processing solution, and does not deteriorate the processing solution to adversely affect photographic properties. Preferred examples of such material include various resins such as polyethylene, polypropylene, polyphenylene oxide (PPO), acrylonitrile-butadiene-styrene (ABS) resins, phenolic resins, polyesters, and polyurethane resins, ceramics such as alumina, and corrosion resistant metals such as stainless steel, titanium and its alloys, and a mixture thereof. Plastic materials such as polypropylene, PPO and ABS resins are preferred for ease of molding, light weight, and strength.

The compartments 6A to 6E are filled with wash water W in this embodiment.

In the first embodiment, the exit compartment 6E through which the photosensitive strip S exits the tank or wash water is first supplied has a smaller volume than the remaining compartments 6A to 6D. More particularly, the volume v of the exit compartment 6E is selected so as to meet the following relationship:

$$v = k\frac{V}{n} \quad (1)$$

wherein V is the total volume of the wash tank (compartments plus channels), n is the number of compartments, and $0<k<1$, k preferably has a value of from 0.1 to 0.8, more preferably from 0.2 to 0.5. The design of the compartments to meet relationship (1) ensures an increased washing efficiency particularly when processing is commenced again after a quiescent period as will be described later. In the illustrated embodiment, the total volume V is in the range of from 1 to 20 liters, preferably from 3 to 10 liters, and the exit compartment 6E has a volume v of 0.1 to 2 liters, preferably 0.2 to 1 liter. Generally speaking, the total volume V largely depends on the number of compartments n. Often, the number of compartments n is 3 to 15, preferably 5 to 10, the total volume V ranges from 1 to 20 liters, preferably from 3 to 10 liters, and the compartment to which wash water is first supplied has a volume v of 0.1 to 2 liters, preferably 0.2 to 1 liter.

The breadth or gap distance of the channels 71 to 76 is preferably about 5 to 40 times the thickness of the photosensitive strip S, typically about 0.5 mm to about 5 mm. The channels of such a breadth allow the photosensitive strip S to travel therethrough without any disturbance. The channels between adjoining compartments each may be about 10 to 200 mm long, preferably 20 to 60 mm long, more preferably 30 to 50 mm long in the travel direction of the photosensitive material although a particular channel length largely depends on the particular shape and dimensions of the compartments.

The continuous path having the compartments connected through such narrow channels allows little passage of wash water between two adjoining compartments when no photosensitive strip S is processed, but allows controlled passage of wash water between two adjoining compartments during processing of photosensitive strip S. The term "little passage" means that the amount of wash water moving between two adjoining compartments is as little as negligible, for example, the flow rate of moving wash water is less than about 2 ml/min. The term "controlled passage" means that the amount of wash water moving between two adjoining compartments is equal to or less than the amount of wash water replenished, for example, the flow rate of moving wash water is from about 0.1 to about 200 ml/min., preferably from about 1 to about 20 mi/min. It is to be noted that the wash water moves in a direction opposite to the travel direction of photosensitive strip S, that is, in a counterflow direction.

For facilitated passage of photosensitive strip S, the channels 71 to 76 on the opposed surfaces may be chemically treated to be water repellent or mechanically corrugated.

Disposed approximately at the center in each of the processing compartments 6A, 6B, 6D, and 6E are a pair of feed rollers 80. Three pairs of feed rollers 80 are disposed in the processing compartment 6C at the lowermost stage. Disposed in proximity to the inlet of the first channel 75 are a pair of entrance rollers 80 for carrying the photosensitive strip S into the tank or wash water W in the entrance compartment 6A. Disposed in proximity to the outlet of the last channel 76 are a pair of exit rollers 80 for carrying the photosensitive strip S out of the tank or wash water W in the exit compartment 6E.

These feed rollers 80 are pivotally supported to the blocks 40 and 45 as shown in FIG. 2. In each of roller pairs, either or both of the rollers in frictional contact with each other are driven for rotation so that the paired rollers can carry the photosensitive strip S forward while frictionally clamping it therebetween.

The drive mechanism for the rollers 80 is illustrated in FIG. 2. A vertical drive shaft 82 extends through a bore in the side block 45. Bevel gears 83 are fixedly secured to the shaft 82 at predetermined positions. Each of the feed rollers 80 includes a horizontally extending shaft 81 having a bevel gear 84 fixedly secured to one end thereof. The bevel gear 84 on the roller shaft 81 is in mesh with the bevel gear 83 on the drive shaft 82. Then, each feed roller 80 can be rotated by rotating the drive shaft 82 in a predetermined direction by means of a suitable drive such as a motor (not shown).

The entrance rollers 80 also have horizontally extending shafts **81*a* and 81*b* somewhat offset from the drive shaft 82 (the entrance rollers 80 are off the vertical line connecting the feed rollers 80 as seen from FIG. 1). A gear 85 is fixedly secured to the drive shaft 82. A driven shaft 86 is supported parallel to the drive shaft 82 and coupled to the drive shaft 82 through a gear train including the gear 85 on the drive shaft 82. A bevel gear 83 is fixedly secured to the driven shaft 86. Another bevel gear 84 is fixedly secured to the shaft 81*a* of one roller at one end thereof. The bevel gear 84 on the roller shaft 81*a* is in mesh with the bevel gear 83 on the driven shaft 86. The roller shaft 81*a* also has a gear 87 secured thereto inside the bevel gear 84, which is in mesh with a gear 88 secured to the shaft 81*b* of the other roller 80 at one end thereof. Then both the rollers 8 are simultaneously rotated with the rotation of the drive shaft 82**.

For each pair of feed rollers 80 in the processing compartment, one roller is driven for rotation and the other roller is rotated therewith due to frictional engagement between their peripheral surfaces. It is possible to couple the rollers of each pair through gears so that both the rollers are driven for rotation as in the case of the entrance rollers 80.

The rollers may preferably be formed of a material which is durable, undergoes no deformation, expansion or weakening under the action of processing solution (or wash water), and does not deteriorate processing solution (or wash water) to adversely affect photographic properties. Examples of the roller-forming material include various rubbers such as neoprene and EPT rubber; elastomers such as Sunprene® (flexible vinyl chloride compound, Mitsubishi Monsanto K.K.), Thermolan®, and Hytrel®; various resins such as rigid vinyl chloride resin, polypropylene, polyethylene, ABS resin, PPO, nylon, POM, phenolic resin, silicone resin and Teflon®; ceramic materials such as alumina; corrosion resistant metals such as stainless steel, titanium and its alloy and Hastelloy, and a mixture thereof.

Disposed above and below the feed rollers 80 in each of the compartments 6A, 6B, 6D and 6E are two pairs of guide plates 89 for guiding the photosensitive strip S. Disposed between the feed rollers 80 in the lowest compartment 6C are reverse guides 91 in the form of an arcuate plate for assisting in reversing the travel direction of the photosensitive strip S.

These guide members 89 and 91 may be of strip metal or molded plastic material. Often the guide members are formed with perforations 90 distributed approximately uniformly thereon. The perforations 90 in the guide members 89 and 91 allow passage of wash water W therethrough, resulting in promoted circulation of wash water and increased washing efficiency.

These guide members 89, 91 and the feed rollers 80 cooperate with their drive system to construct transfer means for carrying the photosensitive strip S along the predetermined path.

Each of the compartments 6A to 6E and channels 71 to 74 is filled with wash water W, and fresh water or replenisher is supplied when the photosensitive material S is being processed. In the illustrated embodiment, an inlet port 21 connected to a conduit for supplying fresh water or replenisher is located near the top of the wall defining the exit compartment 6E. An outlet port 22 connected to a conduit for discharging used water is located near the top of the wall defining the entrance compartment 6A.

If desired, at the transitions between the processing compartments 6A to 6E and the channels 71 to 76, shutter means for shutting or closing the transitions during quiescent periods when no photosensitive strip S travels may be provided (though not shown). The shutter means for normally blocking the openings of the compartments 6A to 6E to the channels, but permitting passage of the photo sensitive strip S is described in U.S. Ser. No. 340,820.

Besides, water circulating means combined with properly arranged baffles may be provided in each or some of the compartments (though not shown) so that wash water W may be forced to flow parallel to the surface of photosensitive strip S and transverse to the travel direction of photosensitive strip S. This transverse water flow minimizes the amount of water moving between adjoining compartments and maintains a differential concentration therebetween, thus contributing to an improvement in washing efficiency. The transverse water flow may have a flow rate of about 20 to about 2,000 ml/min.

The operation of the wash tank of the above-illustrated arrangement is now described. The compartments are filled with wash water W. The photosensitive strip S is carried into the wash water W in the entrance compartment 6A of the tank by the entrance rollers 80, successively passed through the serially arranged compartments 6A to 6E along a generally U-shaped pathway where it is washed, and finally carried out of the wash water W in the exit compartment 6E by the exit rollers 80. While the photosensitive strip S is serially passed through the compartments 6A to 6E, it maintains continuous contact with the wash water (or processing solution). That is, the photosensitive strip S is passed through the wash water (or processing solution) in the serially arranged compartments 6A to 6E without contact with the ambient atmosphere. This avoids the movement of a photosensitive material through the ambient atmosphere between adjacent compartments as found in the prior art apparatus, leading to several benefits including improved washing efficiency.

During washing (or processing), fresh water or replenisher is supplied through the inlet port 21 and used water is discharged through the outlet port 22 as an overflow OF. Since the exit compartment 6E to which the replenisher of wash water is first supplied has a smaller volume than the remaining compartments, the water in the exit compartment 6E is immediately displaced by fresh water when replenishment is restarted after interruption.

In addition, chemicals are entrained by the photosensitive strip S from the preceding tank to the wash tank. The concentration of chemicals is high in the compartment 6A and subsequently lowers in compartments 6B, 6C, 6D and 6E. Since the wash water in one compartment moves to the adjoining compartment in a controlled flow rate even during processing as previously described, the differential concentrations are maintained among the compartments 6A to 6E, also contributing to an improvement in washing efficiency.

Fresh water may be supplied by a pump or the like while used water may be discharged in an overflow manner as described above or forcedly as by a pump.

During a quiescent period when the processing operation is interrupted, it is desired to drain the wash water from the exit compartment 6E to which wash water is first supplied so that the compartment 6E is substantially free of wash water according to the second form of the invention.

The requirement is to empty at least the compartment 6E. As the compartment 6E is emptied of water, the compartment 6A also becomes empty (because the compartments 6E and 6A are on an approximately equal horizontal level in the illustrated embodiment). It is acceptable that the wash waters be partially left in the compartments 6E and 6A. The wash waters may be partially or entirely left in the compartments 6B and 6D.

Usually, the wash water is drained from the path through a drain port 23 in the intermediate or lowermost compartment 6C at least until the compartments 6A and 6E become substantially empty. It will be understood that the drain port 23 may be located at any desired position vertically below the compartment 6E. Then the compartment 6E may be emptied of the wash water by opening a valve associated with the drain port at the end of operation. Since the wash water in the compartment 6A is most contaminated, it is also desired to locate a drain port near the bottom of the compartment 6A so that the compartments 6A and 6E are substantially emptied of the wash water.

According to the second form of the invention, the exit (or first) compartment 6E is emptied of the wash water during the quiescent period, and fresh water is supplied into the compartment 6E through the inlet port 21 at the restart of operation. Then it is unnecessary to fully drain water from the wash tank at the end of operation as in the prior art apparatus. The invention offers advantages including ease of operation and a saving of wash water.

Temporary drainage of wash water from the compartment 6E does not adversely affect washing in that a high washing efficiency is obtained immediately after processing is restarted at the end of the quiescent period.

In the foregoing description, the concept of emptying the exit compartment 6E of the wash water W during a quiescent period is applied to the wash tank in which the exit compartment 6E has a smaller volume than the remaining compartments. However, this concept is applicable to any wash tank having a plurality of compartments irrespective of their relative volume. For efficient washing at the restart of processing, it is desirable that the exit compartment 6E has a smaller volume than the remaining compartments.

Although the present invention has been described as being embodied in a wash tank, the invention is equally applicable to any other processing tanks including developing, bleaching, bleach-fixing, fixing and stabilizing tanks. In the case of a stabilizing tank, the same construction as the wash tank may be used except that the tank is filled with a stabilizing solution instead of the wash water.

In the case of a developing, bleaching, bleach-fixing, or fixing tank, the tank construction is somewhat modified from that of the wash tank because the processing solution with which the tank is filled is preferably passed in the same direction as the travel direction of photosensitive material, that is, in a parallel flow.

Figure 3:
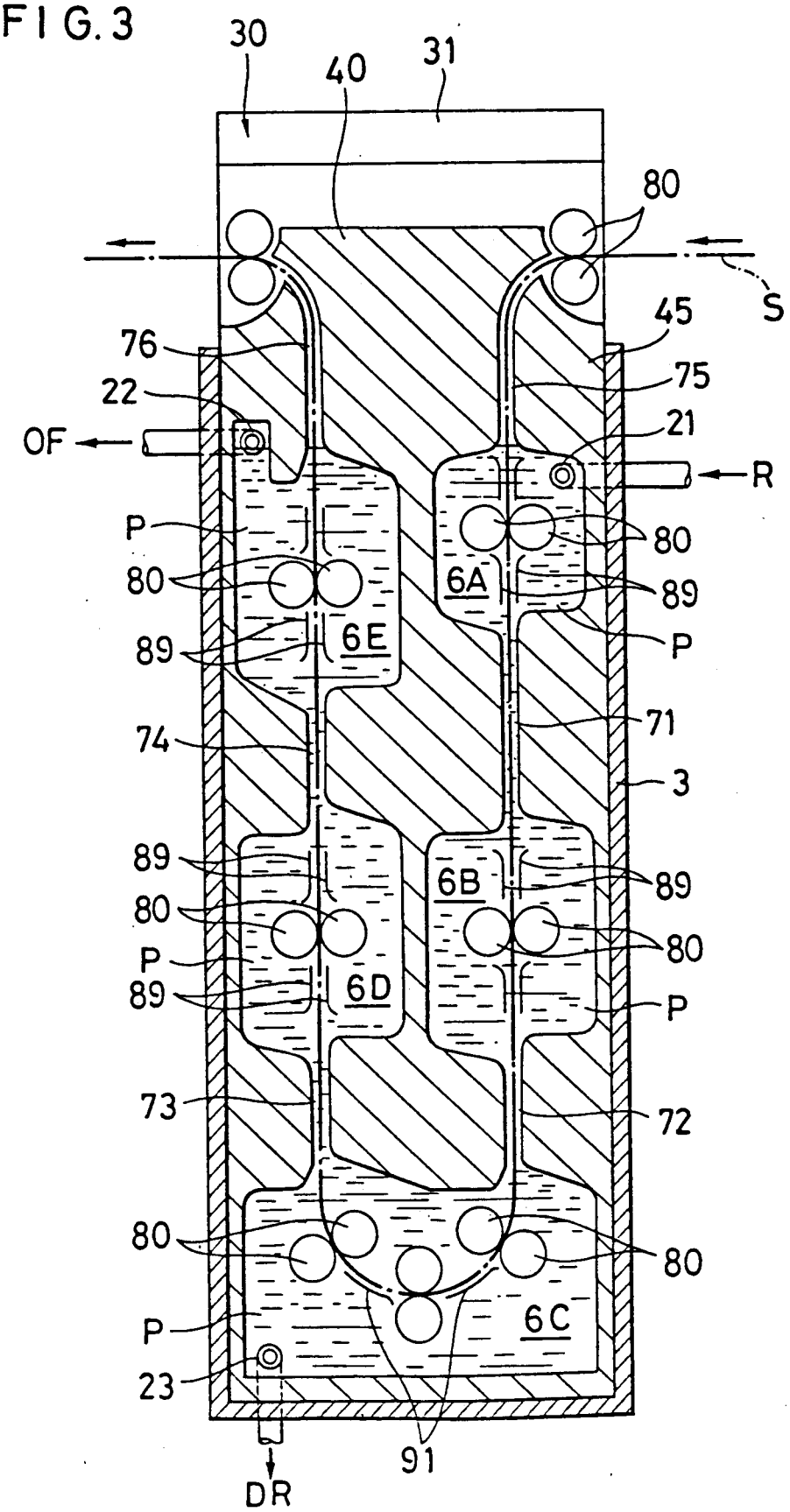
FIG. 3 is a vertical cross section of a processing tank according to a second embodiment of the invention.

FIG. 3 illustrates such a modified tank construction. The processing tank of FIG. 3 has approximately the same configuration as the wash tank of FIGS. 1 and 2 except the following difference. Since a processing solution P assumes a parallel flow with respect to the travel direction of a photosensitive strip S, inlet and outlet ports 21 and 22 are located in the entrance and exit compartments 6A and 6E, respectively. A replenisher R for the processing solution P is supplied to the entrance compartment 6A through the inlet port 21, and the processing solution P is discharged from the exit compartment 6E as an overflow OF through the outlet port 22. The entrance compartment 6A has a smaller volume than the remaining compartments because it is the compartment to which the processing solution is first supplied.

This processing tank can also maintain concentration gradients among the compartments and avoid the contact of photosensitive material with the ambient atmosphere as does the wash tank.

At the restart of processing operation, the processing solution whose activity is more or less lowered in the entrance compartment 6A is immediately displaced by a fresh solution or replenisher. Then processing is carried out at the same high efficiency as in the steady state from the beginning of restarted operation.

During a quiescent period when the processing operation is interrupted, it is desired to drain the processing solution from the entrance compartment 6A to which the processing solution is first supplied so that the compartment 6A is substantially free of the processing solution according to the second form of the invention. Usually, the processing solution is drained from the path through a drain port 23 in the intermediate or lowermost compartment 6C at least until the compartments 6A and 6E become substantially empty partially because the processing solution in the exit compartment 6E is most contaminated.

Figure 4:
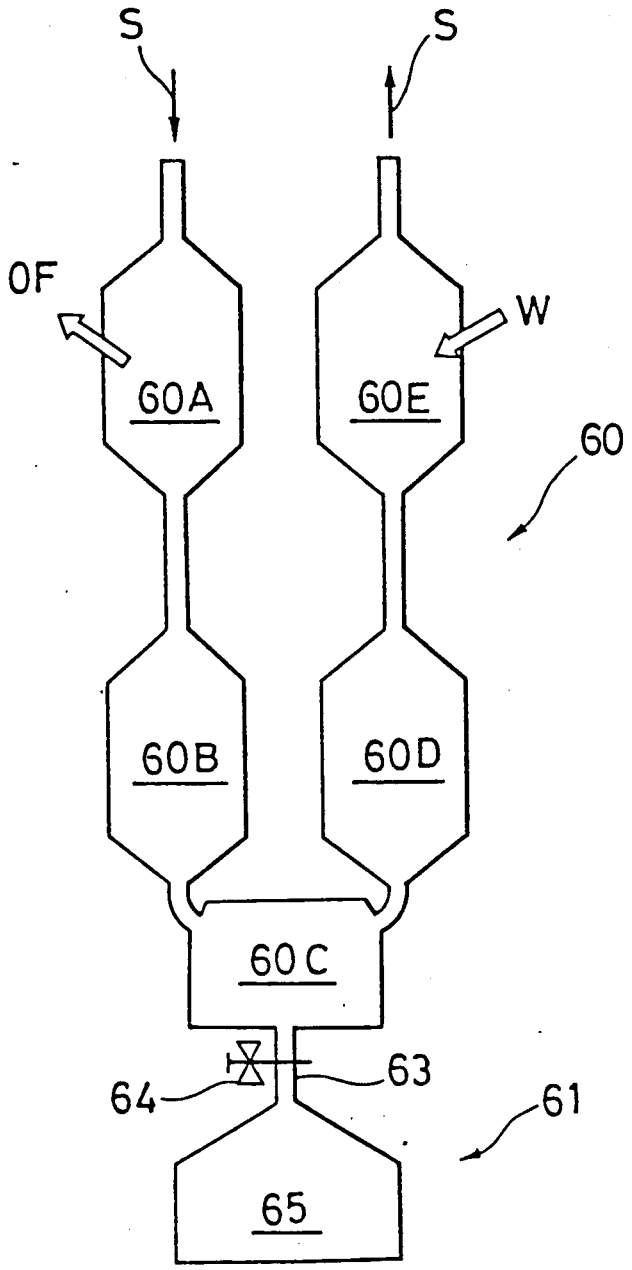
FIG. 4 is a schematic illustration of a wash tank according to a third embodiment of the invention, showing a sump into which wash water is drained from the lowermost compartment.

FIG. 4 schematically illustrates a wash tank embodying a processing apparatus according to the third form of the present invention.

The wash tank shown in FIG. 4 includes a wash section 60 and a reservoir section 61. The wash section 60 may have the same configuration as the wash tank of FIGS. 1 and 2 except that no particular limit is imposed on the relative volume of compartments 60A to 60E which correspond to the compartments 6A to 6E of FIG. 1. Since FIG. 4 schematically illustrates only the contour of processing compartments and channels, all the remaining components including the housing, blocks, feed rollers, and guides are omitted for brevity of illustration. In the figure, the supply of wash water is depicted by a thick arrow W, the discharge or overflow of used water is depicted by a thick arrow OF, and the entering and exiting directions of photosensitive material S are depicted by solid arrows.

The reservoir section 61 includes a sump 65 connected for fluid communication to the lowermost compartment 60C of the wash section 60 through a conduit 63. The conduit 63 is provided with a valve 64 for restraining the communication between the compartment 60C and the sump 65 during operation, that is, when the photosensitive strip S is washed with water through the compartments, but allowing the communication therebetween to drain the wash water to the sump 65 during a quiescent period, that is, when no photosensitive strip S is passed through the compartments. The means for selectively restraining the communication between the lowermost compartment 60C and the sump 65 is not limited to the valve 64, and any well-known shutters or the like may be used instead.

In the wash section 60, the photosensitive strip S is serially passed through the compartments 60A to 60E while it is washed with water as previously described. At the end of water washing or during a quiescent period, the valve 64 is opened to drain a predetermined amount of the wash water W from the compartment 60C to the sump 65.

As previously described, differential concentrations are maintained among the compartments 60A to 60E during washing operation. The wash waters W in the compartments 60A to 60E have a specific gravity SG in the order of $SG_{60A} > SG_{60B} > SG_{60C} > SG_{60D} > SG_{60E}$ in proportion to their differential concentrations. With the lapse of time of about one hour to five hours from the end of washing operation, the wash waters W in the compartments 60A to 60E will vary the order of their specific gravity. In the washing tank of the illustrated configuration, a slight leakage or migration occurs between the compartments during a quiescent period. That is, specific gravity-governing ingredients predominantly present in the compartments 60A and 60B tend to gradually migrate downward and collect in the lowermost compartment 60C. Therefore, the volume of wash water in the lowermost compartment 60C is drained to the sump 65 during a quiescent period according to the present invention. Then the maximum specific gravity or most contaminated portion of the wash water can be drained. When it is desired to restart the processing of photosensitive material, fresh water is supplied to the path through the compartment 60E in an amount corresponding to a shortage, filling all the compartments 60A to 60E with the wash water W. The drainage and re-charging operation is simple and washing operation can be restarted at high efficiency from the beginning.

The reservoir section 61 is detachably connected to the wash section 60. More particularly, the sump 65 is disconnected from the compartment 60C and emptied of the drain water as necessary. The wash and reservoir sections 60 and 61 may be received in a common housing or separate housings. The water drained to the reservoir section 61 may be used as a diluent for another processing tank. The wash water may be drained under gravity or forcedly by means of a pump or the like.

Figure 5:
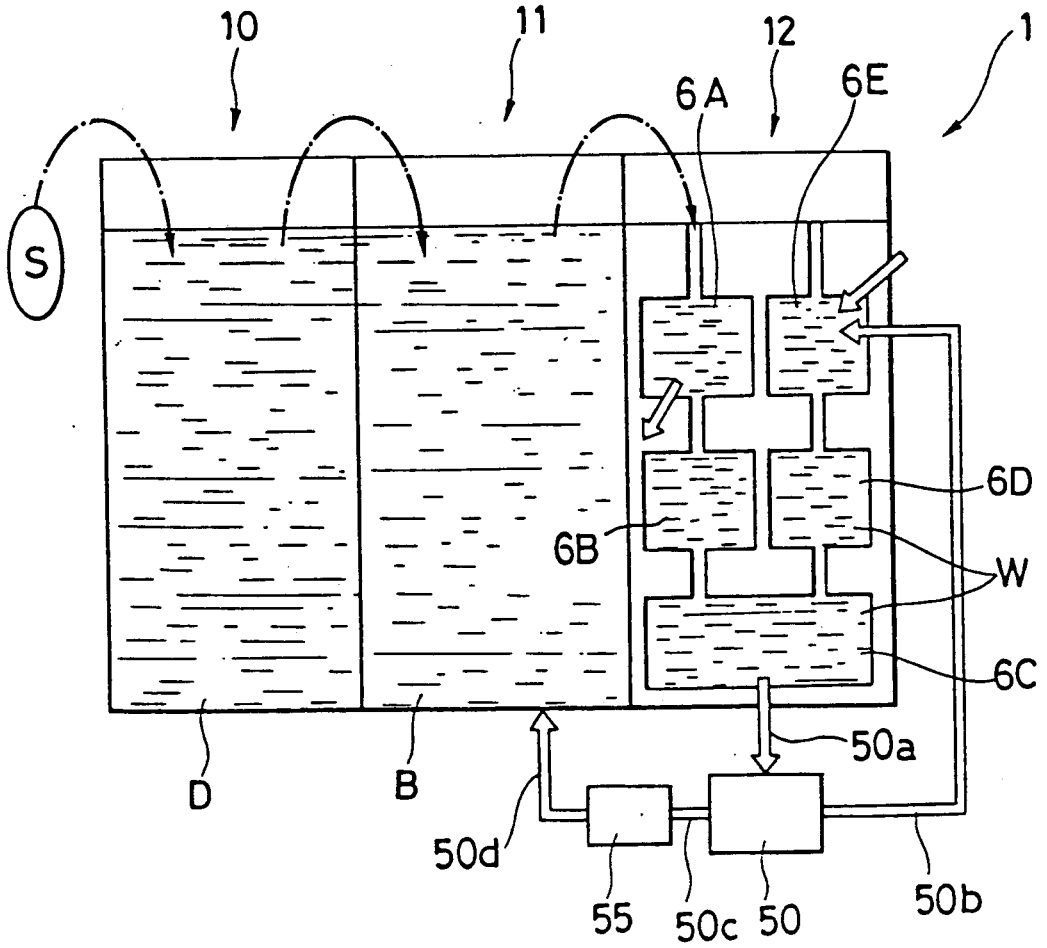
FIG. 5 is a schematic illustration of a processing apparatus according to a fourth embodiment of the invention, showing a recycle system including a reverse osmosis (RO) unit and recycle lines.

Referring to FIG. 5, a processor arrangement is illustrated as embodying a photosensitive material processing apparatus in the fourth form of the present invention.

The processor generally designated at 1 is adapted to process a photosensitive material or strip S after exposure. The processor 1 includes a developing tank 10, a bleach-fixing tank 11, and a washing tank 12 for the steps of developing, bleach-fixing and washing the photosensitive strip S. The developing tank 10 is filled with a developer D, the bleach-fixing tank 11 is filled with a blix solution B, and the washing tank 12 is filled with wash water W. The photosensitive strip S is successively transferred through the tanks while it is processed with the respective solutions.

Figure 6:
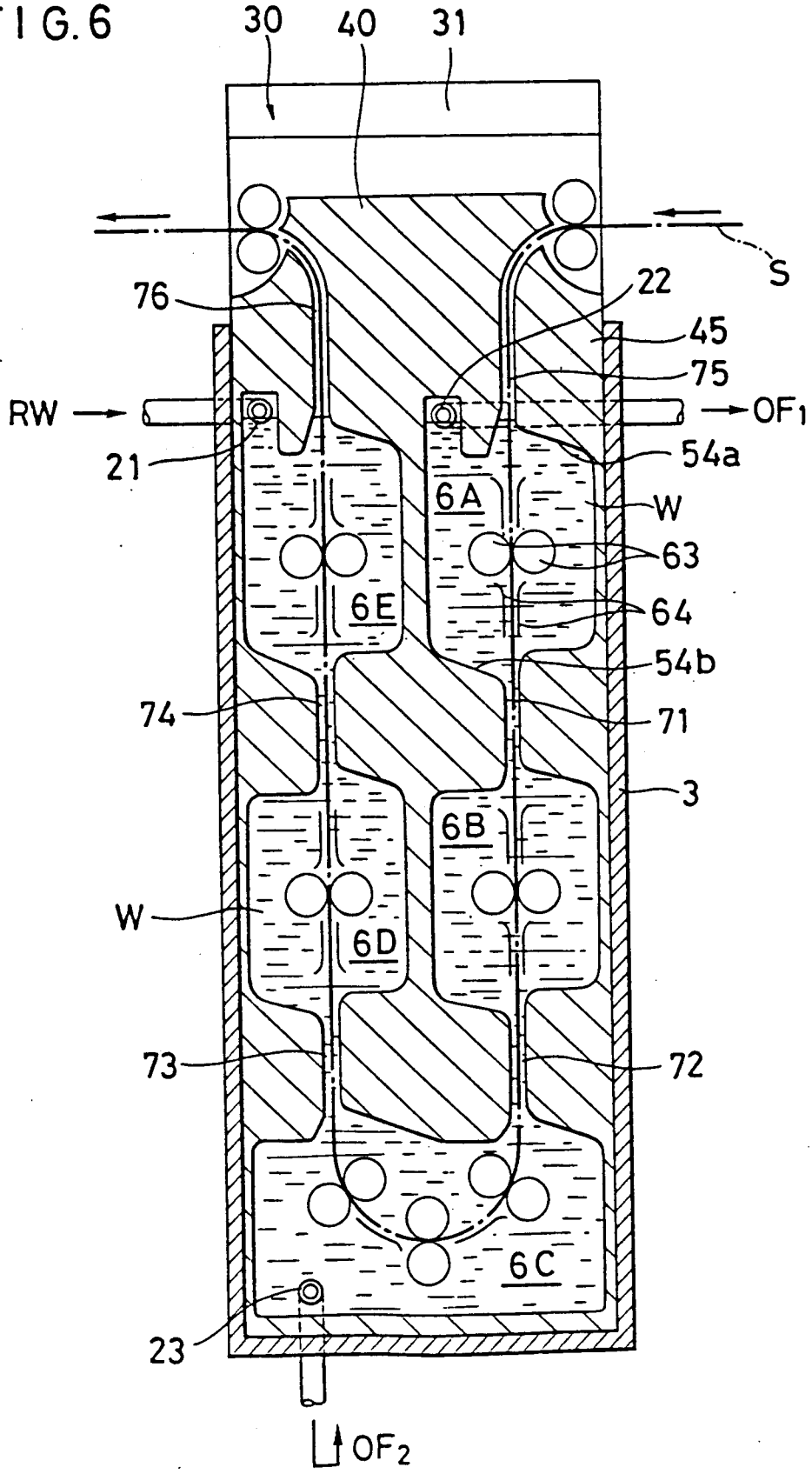
FIG. 6 is a vertical cross section of the wash tank used in the apparatus of FIG. 5.

The wash tank 12 is illustrated in FIG. 6 as comprising a plurality of compartments 6A to 6E serially connected through narrow channels 71 to 74. This tank has substantially the same configuration as the wash tank of FIGS. 1 and 2. It is desired that the developing and bleach-fixing tanks 10 and 11 in FIG. 5 also have substantially the same configuration as the wash tank of FIGS. 1 and 2 because this multiple-compartment type of processing tank can minimize the amount of processing solution used in processing photosensitive material.

In the fourth form of the invention, the processor 1 further includes a recycle system for separating used wash water into concentrate and dilute portions for reuse. As shown in FIG. 5, the recycle system includes a reverse osmosis unit 50, conduits 50*a*, 50*b*, 50*c*, and 50*d*, and an aerator unit 55. The reverse osmosis unit 50 serves to separate the used wash water into concentrate and dilute portions through reverse osmosis. The dilute and concentrate portions are used in connection with the chemical compounds which are carried into the wash water from the preceding tank solution during operation. The dilute portion is a water containing a less amount of chemical compounds or a chemical compound-free water and the concentrate portion is a water containing a relatively larger amount of chemical compounds.

The concentrate portion is fed to the bleach-fixing tank 11 through the conduit 50C, aerator unit 55, and conduit 50*d*. The concentrate water is preferably fed to the bleach-fixing tank 11 in a parallel flow relationship. To this end, the bleach-fixing tank 11 should preferably have the configuration shown in FIG. 3. Modifications are made such that the entrance compartment 6A where the photosensitive strip S enters the tank is provided with an inlet port 21, and the exit compartment 6E where the photosensitive strip S exits the tank is provided with an outlet port 22. The conduit 50*d* (FIG. 5) is connected to the inlet port 21 (FIG. 3).

As shown in FIGS. 5 and 6, the lower compartment 6C of the wash tank 12 is provided with a drain port 23 which is connected to the conduit 50*a* so that the used wash water W is drained from the compartment 6C to the reverse osmosis unit 50 through the conduit 50*a*.

The dilute water portion from the reverse osmosis unit 50 is fed back to the compartment 6E of the wash tank 12 through the conduit 50*b* connected to the inlet port 21 so as to provide a counter flow with respect to the travel direction of photosensitive strip S. It is to be noted that the wash water W can overflow from the compartment 6A through the outlet port 22.

The reverse osmosis unit 50 as the water separating means used herein may be a tubular module manufactured by Paterson Candy International Ltd. This module has the following specifications.

Diaphragm material: cellulose acetate
Diaphragm area: 30 $m^2$ in total
Operating pressure: 10 to 20 $kg/cm^2$ In the practice of the invention, a reverse osmosis unit having a lower operating pressure can be used. This also contribute to a size reduction of the overall apparatus.

By separating the used wash water into concentrate and dilute portions through a reverse osmosis unit and feeding back the dilute portion to the wash water and the concentrate portion to the bleach-fixing solution, it becomes possible to save the wash water and to reduce the amount of bleach-fixing solution replenished. Specifically stated, the amount of bleach-fixing solution replenished can be reduced about 10% to about 50% by volume, and the amount of wash water replenished can be reduced about 10% to about 40% by volume. An additional benefit is an increased silver recovery.

Figure 7:
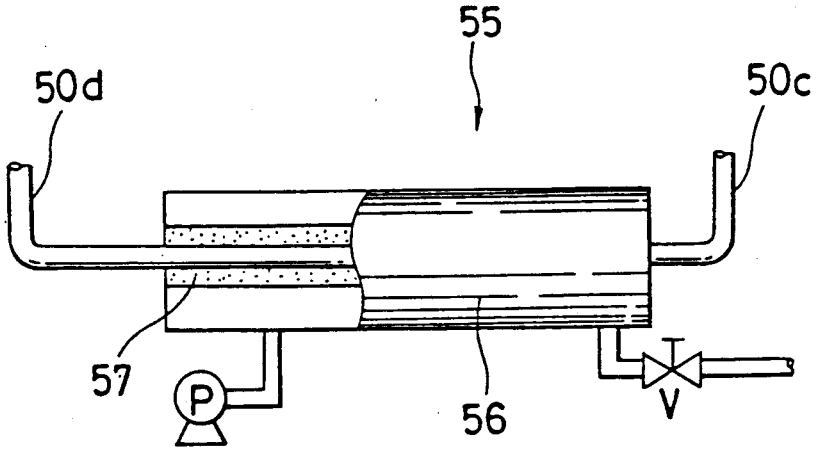
FIG. 7 is a partially cut-away elevation of the aerator used in the apparatus of FIG. 5.

The aerator unit 55 is disposed between the concentrate conduits 50*c* and 50*d* as shown in FIG. 5. The aerator unit 55 is illustrated in FIG. 7 as including a porous cylinder 57 enclosed in a cylindrical shell 56, which is connected to a pump P and to a valve V through separate conduits. The pump P pumps compressed air to the interior of the shell 56 and the porous cylinder 57 allows the air to be bubbled into the concentrate water flow through the conduits 50*c* and 50*d*. The valve V serves to adjust the air pressure in the shell 56.

The porous cylinder 57 may have a pore size of 0.02 to 10 μm, preferably about 1 to 10 μm. It is usually made of a ceramic material or any other porous material which has no deleterious effect on the concentrate water flow. The introduction of compressed air may be carried out by the method described in JP-A No. 251747/1988. Usually, air is compressed under a pressure of about 1.1 to about 10 atmospheres, preferably about 1.2 to about 3 atmospheres. Alternatively, oxygen permeable membranes such as porous polymeric membranes may be used. The amount of air introduced into the concentrate water flow may be about 0.3 to about 30 liter/min. per liter of the concentrate water.

The aerator unit 55 introduces air into the concentrate water flow to the bleach-fixing tank where the air enhances the bleaching action of bleaching agents in the bleach-fixing solution. The promotion of bleaching action is more outstanding when the quantity (or area) of photosensitive material processed per unit time ranges from the standard to a substantially increased quantity. For occasional processing, that is, when only a small quantity (or area) of photosensitive material is processed per unit time, spontaneous air oxidation will suffice so that there is no need for an aerator.

In the processor of this embodiment, the processing solutions are preferably supplied only when the photosensitive material S is passed therethrough. The number and position of inlet and outlet ports 21, 22 and 23 are not limited to the illustrated embodiment.

The photosensitive strip S is successively transferred through the developing tank 10, bleach-fixing tank 11, and wash tank 12 while it is processed with the respective solutions. Since the used or exhausted portion of the wash water is separated into concentrate and dilute portions through the recycle system including the separating means in the form of a reverse osmosis unit whereby the dilute portion is fed back to the wash water and the concentrate portion is recycled to the bleach-fixing solution, the amounts of wash water and bleach fixing solution replenished can be reduced.

The separating means is not limited to the reverse osmosis unit. One alternative is a separator unit wherein the used water is concentrated by evaporating some water into water vapor which is then condensed into water. Such a unit may be selected from the evaporation/condensation separators disclosed in JP-A Nos. 200882/1988, 200883/1988, and 156501/1988.

Figure 8:
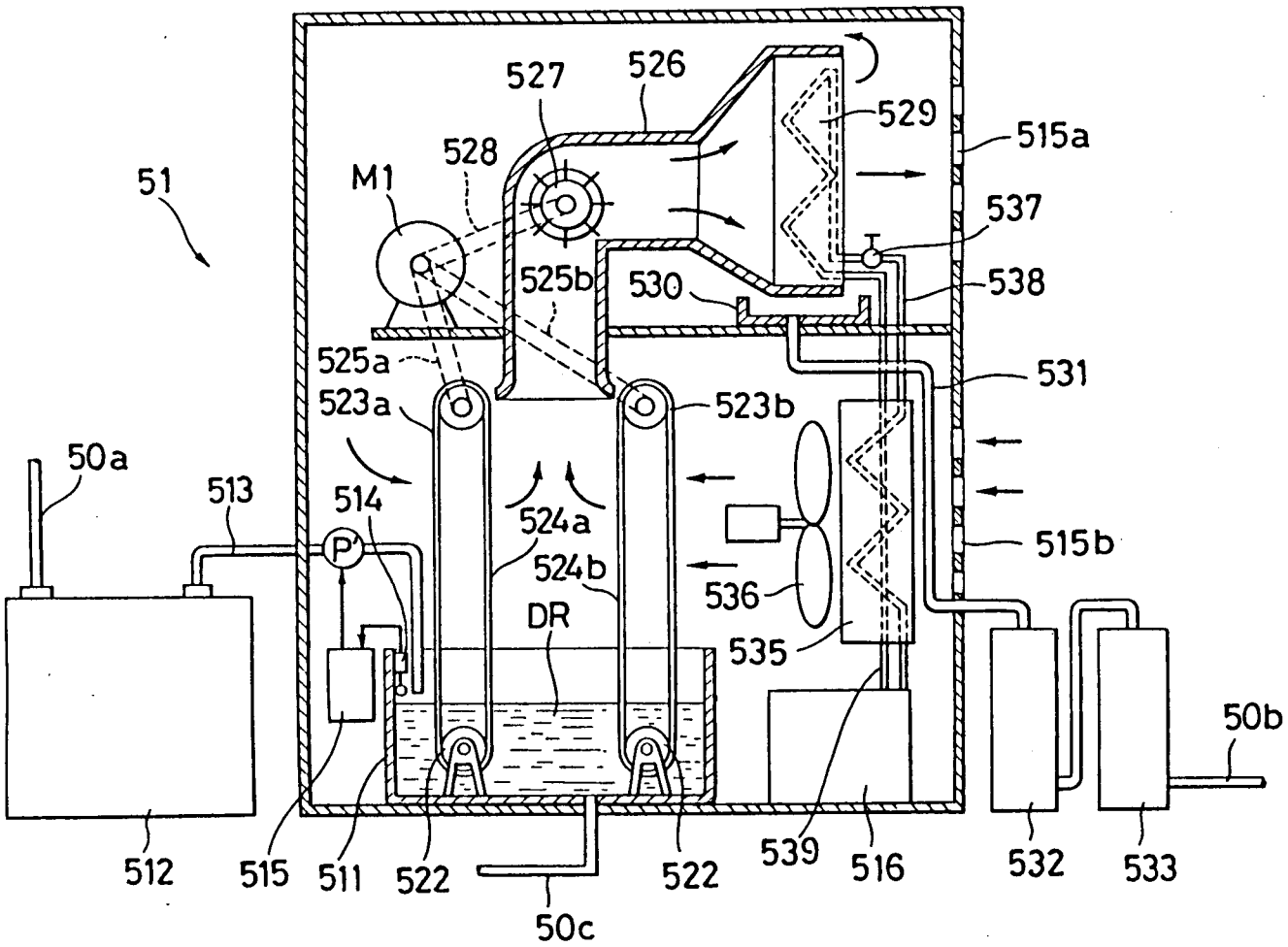
FIG. 8 is an elevational cross-section of an evaporation/condensation separator which can be used in the apparatus of FIG. 5.

FIG. 8 illustrates a typical evaporation/condensation separator. The separator generally designated at 51 includes a casing 510 and a used water-containing trough 511 therein. A used water sump 512 contains therein used wash water which is delivered to the trough 511 through a conduit 513. The conduit 513 is provided with a pump P' which is controlled by a float switch 514 and a pump drive circuit 515. The pump P' is actuated until the float switch 514 detects the surface of used water DR. To the trough 511 at the bottom is connected the conduit 50*c* (see FIG. 5) for delivering the concentrated water to the bleach-fixing tank 11 to join the bleach-fixing solution B therein for reuse.

In the trough 511 are disposed lower pulleys 522*a* and 522*b*. Upper pulleys 523*a* and 523*b* are disposed in the casing 510. Endless belts 524*a*, 524*b* are extended around the lower pulleys 522*a*, 522*b* and the upper pulleys 523*a*, 523*b*, respectively. The upper pulleys 523*a* and 523*b* are connected to a motor M1 through V belts 525*a* and 525*b*, respectively. Above the upper pulleys 523*a* and 523*b* is disposed a duct 526. A fan 527 is located in the duct 526 and connected to the motor M1 through a V belt 528. When the motor M1 is actuated, it causes the fan 527 to rotate and at the same time, the belts 524*a* and 524*b* to turn around. The water entrained on the belts 524*a* and 524*b* evaporates into water vapor. Then air containing water vapor is delivered through the duct 526 to a condenser 529 where the water vapor is condensed and recovered. A portion of the air from which the moisture has been removed is fed back to the evaporator section including the endless belts 524*a* and 524*b* and the remaining air is discharged through a vent 515*a*. Below the condenser 529 is disposed a collector 530 for collecting drips of condensed water. The condensed or distilled water in the collector 530 is delivered to a filter 532 outside the casing 510 through a conduit 531 and then to an ion exchanger 533. The filter 532 is filled with active carbon or similar filter material to remove organic matter from the condensed water. The ion exchanger 533 is filled with a well-known ion-exchange resin to remove metal ions (calcium and magnesium ions) necessary for fungal or microbial growth. The condensed water is then delivered through the conduit 50*b* to the wash tank 12 to join the wash water W for reuse (see FIG. 5).

The casing 510 is formed with a suction port 515*b* through which air is taken into the casing 510 toward a radiator 535 where the air is heated. The heated air is then blown toward the endless belts 524*a* and 524*b* by means of a fan 536. The radiator 535 and the condenser 529 are connected through a refrigerant pipe 538 with an expansion valve 537. The refrigerant is liquefied in the radiator 535 and cooled through the expansion valve 537 before it is delivered to the condenser 529. The refrigerant absorbs the heat of vaporization from the air in the condenser 529 and evaporates into a vapor which is delivered to a compressor 516. The compressor 516 compresses the refrigerant vapor into a superheated vapor which is delivered to the radiator 535. In the radiator 535 the refrigerant is cooled into a liquid by the passing air.

The evaporation/condensation separator 51 of the abovementioned construction is designed such that the used wash water is once stored in the sump 512 and then delivered to the trough 511 by means of the pump P'. When it is desired to regenerate the used water, the motor M1 is actuated to turn the endless belts 524*a* and 524*b* around the pulleys with their lower portions immersed in the used water DR. The used water DR is carried by the belts 524*a* and 524*b* out of the trough 511 and brought into contact with the surrounding air. With the fan 536 actuated, air is taken in through the suction port 515, warmed up through the radiator 535, and then blown toward the endless belts 524*a* and 524*b*. As the warm air is blown toward the belts 524*a* and 524*b*, a water component of the used water on the belts evaporates. The air containing water vapor, that is, wet air is delivered to the condenser 529 through the duct 526 by means of the fan 527. In the condenser 529, the water vapor in the air is cooled and condensed into droplets which will collect in the collector 530. The air from which moisture has been removed is partially circulated to the evaporator section and the remaining air is vented through the vent port 515*a*.

The condensed water in the collector 530 is delivered through the conduit 531 to the filter 532 for removing organic matter and then to the ion exchanger 533 for deionization. The deionized water is then delivered through the conduit 50*b* to the wash tank 12 to join the wash water W for reuse (see FIG. 5).

On the other hand, the evaporation of the used water assisted by the movement of the belts 524*a* and 524*b* leaves a concentrated water in the trough 511. The concentrated water is delivered through the conduit 50*c*, aerator unit 50, and conduit 50*d* to the bleach-fixing tank 11 to join the bleach-fixing solution B for reuse (see FIG. 5).

The endless belts 524*a* and 524*b* is preferably formed from a material which is air permeable and water wettable. For example, resins and fabrics of mesh structure may be used. The number and dimensions of endless belts may be empirically determined.

Although the foregoing description has been made as applying the same configuration as that illustrated in FIGS. 1 and 2, FIG. 3, or FIG. 6 to all processing tanks including developing, bleach-fixing and washing tanks, it is only required in the practice of the invention that such a configuration be applied to at least the washing tank with the developing and bleach-fixing tanks being of the conventional configuration.

The embodiment wherein the used water is separated into concentrate and dilute portions is preferably designed such that the concentrate water portion is reused as a replenisher for the processing solution in the stage prior to the washing stage. The concentrate water portion should preferably be recycled to the preceding stage as a parallel flow with respect to the photosensitive material travel direction.

Where the wash tank of FIG. 6 is equipped with the reverse osmosis unit 50, the inflow conduit 50*a* may be connected to the drain port 22 or 23 so that overflow OF1 or OF2 from the drain port 22 or 23 is led to the reverse osmosis unit 50. Preferred is the connection illustrated in FIG. 5 wherein overflow OF2 from the drain port 23 is led to the reverse osmosis unit 50 where it is separated into concentrate and dilute water portions. The reason is that concentration gradients are generated among the compartments 6A to 6E during processing as previously described. The wash water W in the intermediate compartment 6C has an intermediate concentration, which the overflow OF2 also has. For the purpose of recovering active chemical agents and returning the concentrate water containing them to the processing tank of the preceding stage, selective recycle of the overflow OF1 from the compartment 6A might seem to be more effective. However, the separation of the overflow OF1 which is more contaminated applies an undesirably increased load to the reverse osmosis unit 50, resulting in a reduced life of the diaphragm. In this respect, the separation of the overflow OF2 is preferred to achieve the chemical recovery purpose while extending the diaphragm life. The life of the diaphragm during separation of the overflow OF2 is about 1.3 to about 4 times that during separation of the overflow OF1. In addition, the wash water W in the intermediate compartment 6C is kept out of contact with air and the overflow OF2 can enter the reverse osmosis unit 50 in the air contact free state. This is advantageous in recycling the concentrate water, particularly in suppressing deterioration of fixing agents. In turn, such an advantage is not available with the overflow OF1 because the wash water W in the compartment 6A can be in contact with air.

When a substantially large quantity or area of photosensitive material is processed per unit time, the overflow OF1 may be recycled. If the overflow OF2 is recycled, an aerator is preferably inserted in the outflow conduit as shown in FIG. 5. Differently stated, when the quantity or area of photosensitive material processed per unit time is the standard or smaller, the overflow OF2 from the intermediate compartment should be recycled.

In the embodiment of FIG. 5, to maintain the surface of wash water W at a constant level, the dilute water and fresh water (replenisher) are supplied to the compartment 6E while allowing the wash water W to overflow from the compartment 6A. These flows of wash water are depicted by thick arrows in FIG. 5. In this embodiment, it is preferred that the overflow OF1 from the compartment 6A is allowed only for the purpose of maintaining the surface of wash water W at a constant level. In the recycle mode, the overflow OF1 from the compartment 6A is preferably kept substantially zero or up to 10% of the water supplied to the compartment 6E.

Referring to FIGS. 9 to 12, there are illustrated further arrangements of a processor having wash tanks of the configuration shown in FIG. 6. In these figures, processing tanks, processing solutions, units, and conduits having the same functions as in FIG. 5 are designated by the same reference numerals as in FIG. 5. Two, first and second, wash tanks 12 and 13 are provided in these embodiments. Entrance to exit compartments of second wash tank 13 are designated at 6F, 6G, 6H, 6I, and 6J.

Figure 9:
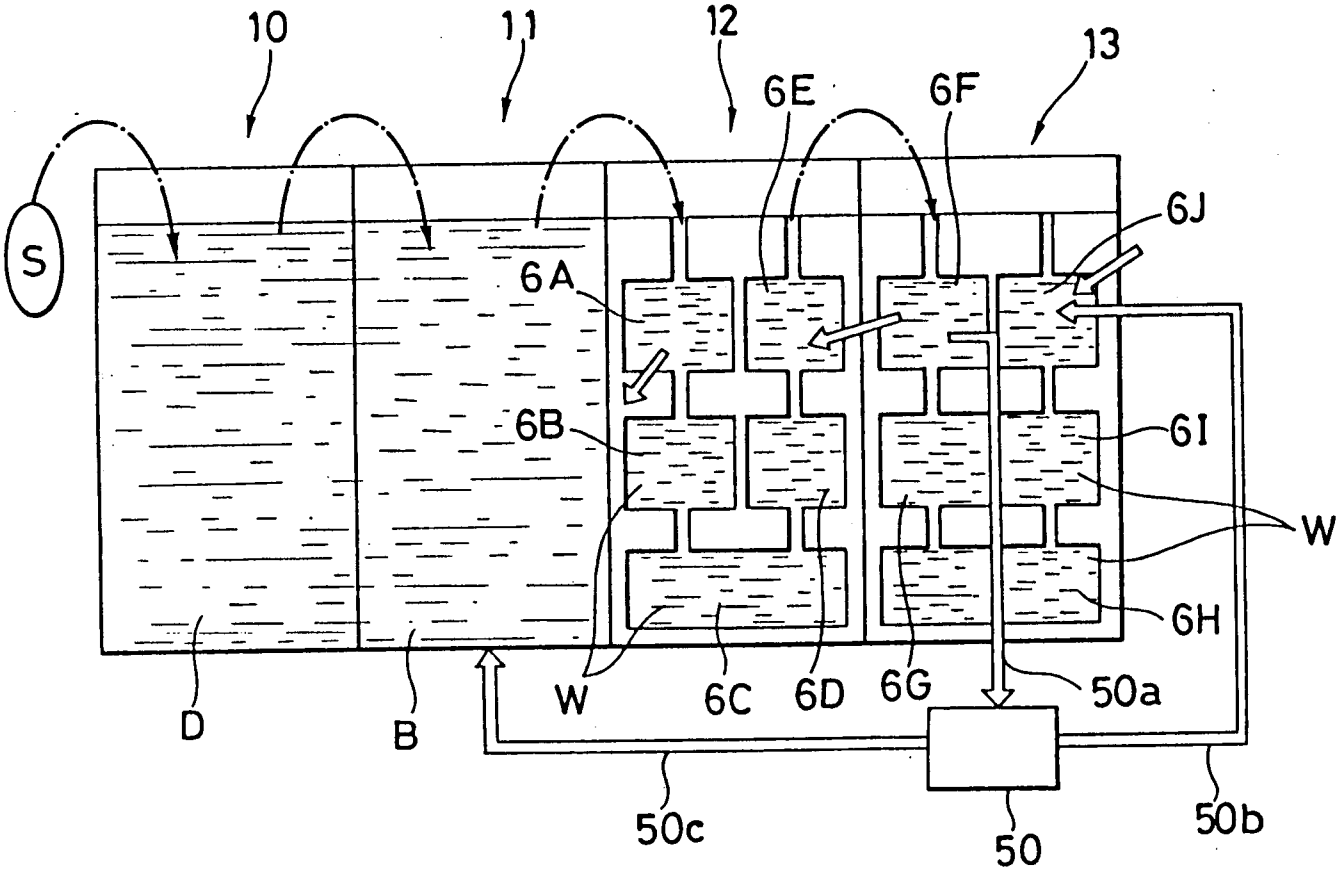
FIGS. 9 to 12 are schematic illustrations of different processing apparatus arrangements according to the fourth embodiment of the invention.

In the embodiment of FIG. 9, an overflow from entrance compartment 6F of the second wash tank 13 is led to reverse osmosis unit 50 through conduit 50*a* where it is separated into concentrate and dilute water portions. The dilute water is fed back to exit compartment 6J through conduit 50*b*, and the concentrate water is returned to the bleach-fixing tank 11 through conduit 50*c*. Fresh water or replenisher is supplied to exit compartment 6J. Part of the overflow from entrance compartment 6F to maintain the surface of wash water in wash tank 13 at a constant level is led to exit compartment 6E of first wash tank 12. The wash water in entrance compartment 6A of first wash tank 12 is allowed to overflow, which overflow is discarded. That is, a multi-stage counterflow mode is employed in the first and second wash tanks 12 and 13.

Figure 10:
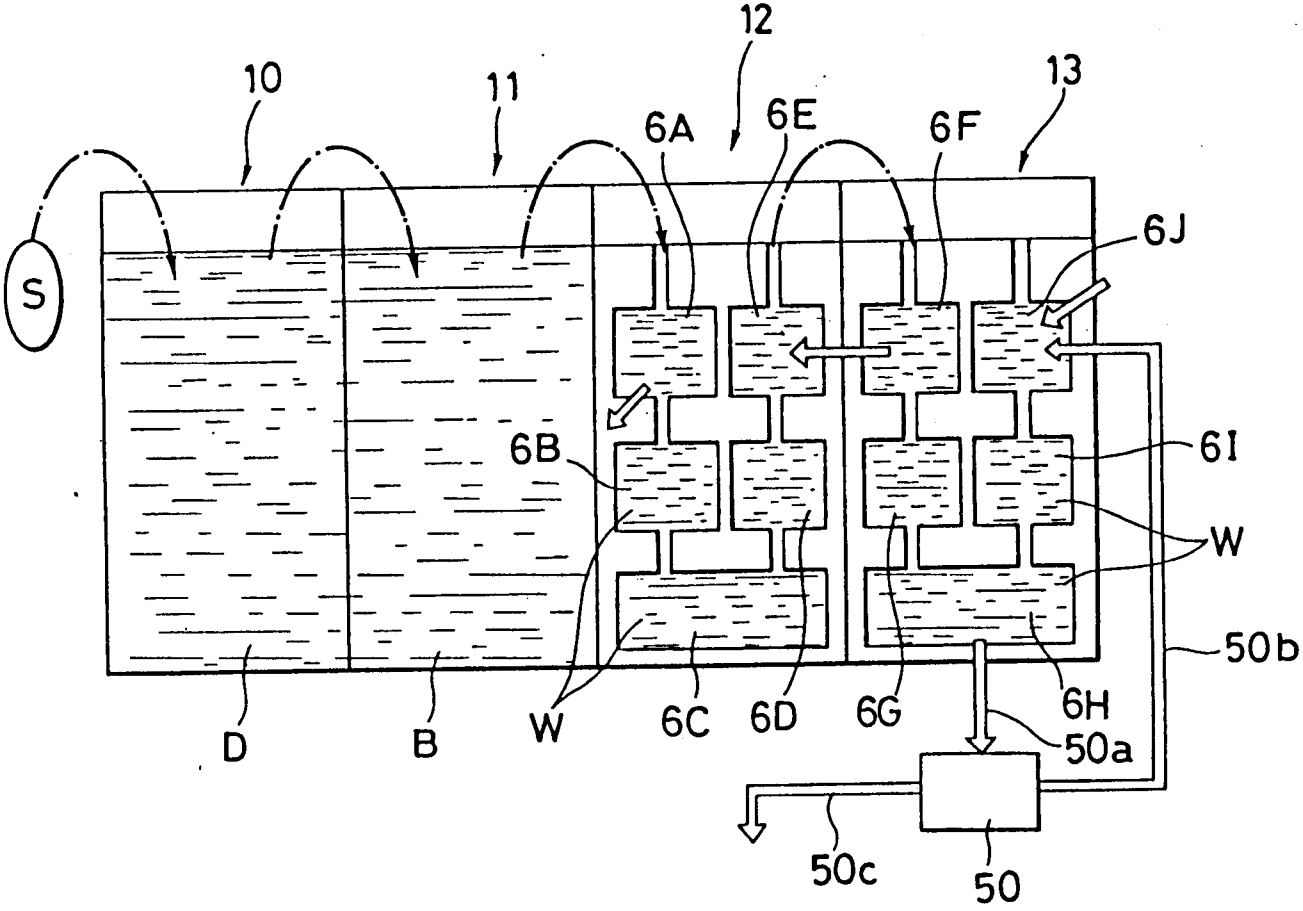

The embodiment of FIG. 10 has substantially the same recycle system as FIG. 9 except that the water in intermediate compartment 6H of second wash tank 13 is drained to reverse osmosis unit 50 and the concentrate water resulting from separation therein is not returned to the bleach-fixing tank, but discarded.

Figure 11:
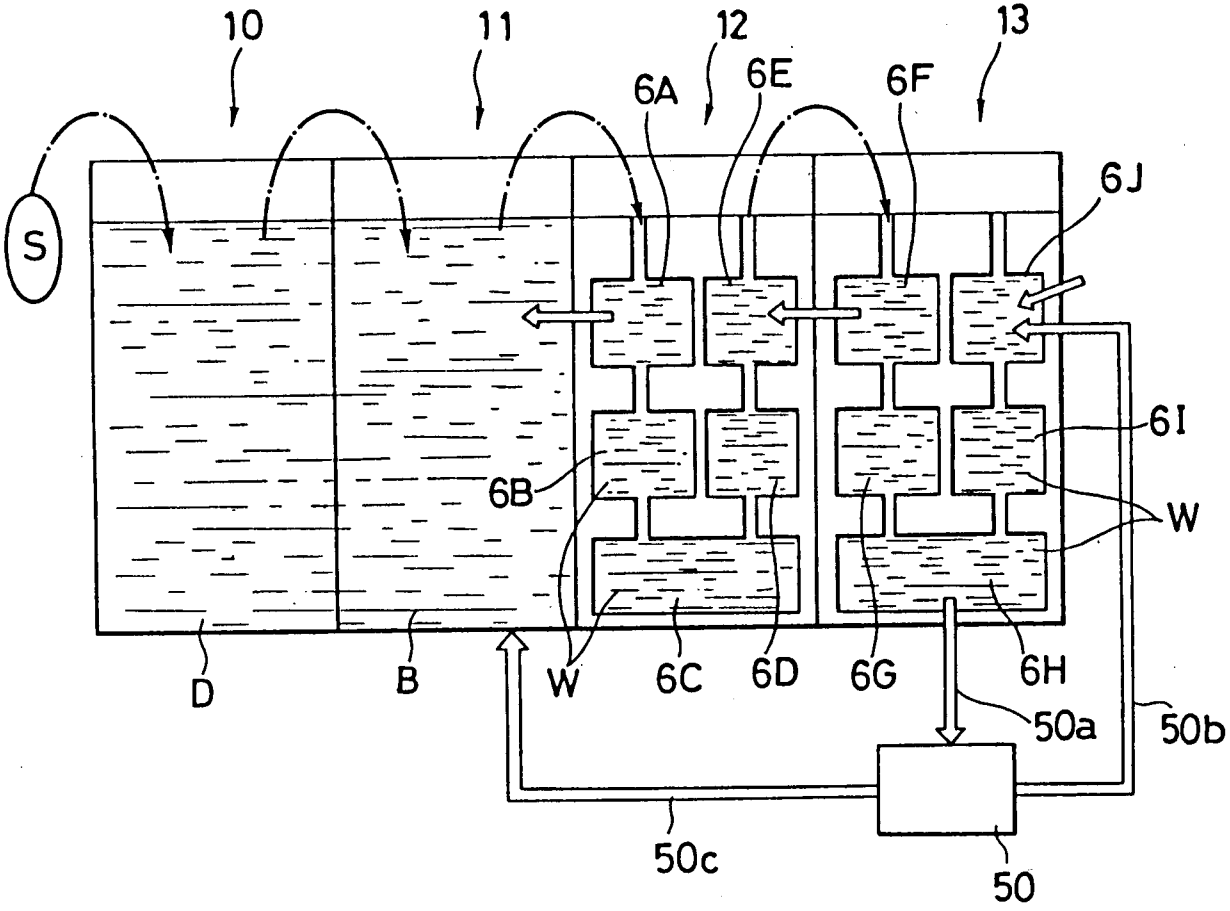

The embodiment of FIG. 11 has substantially the same recycle system as FIG. 10 except that the concentrate water resulting from separation in reverse osmosis unit 50 is returned to the bleach fixing tank 11 and an overflow from entrance compartment 6A of first wash tank 12 is led to the bleach-fixing tank 11.

Figure 12:
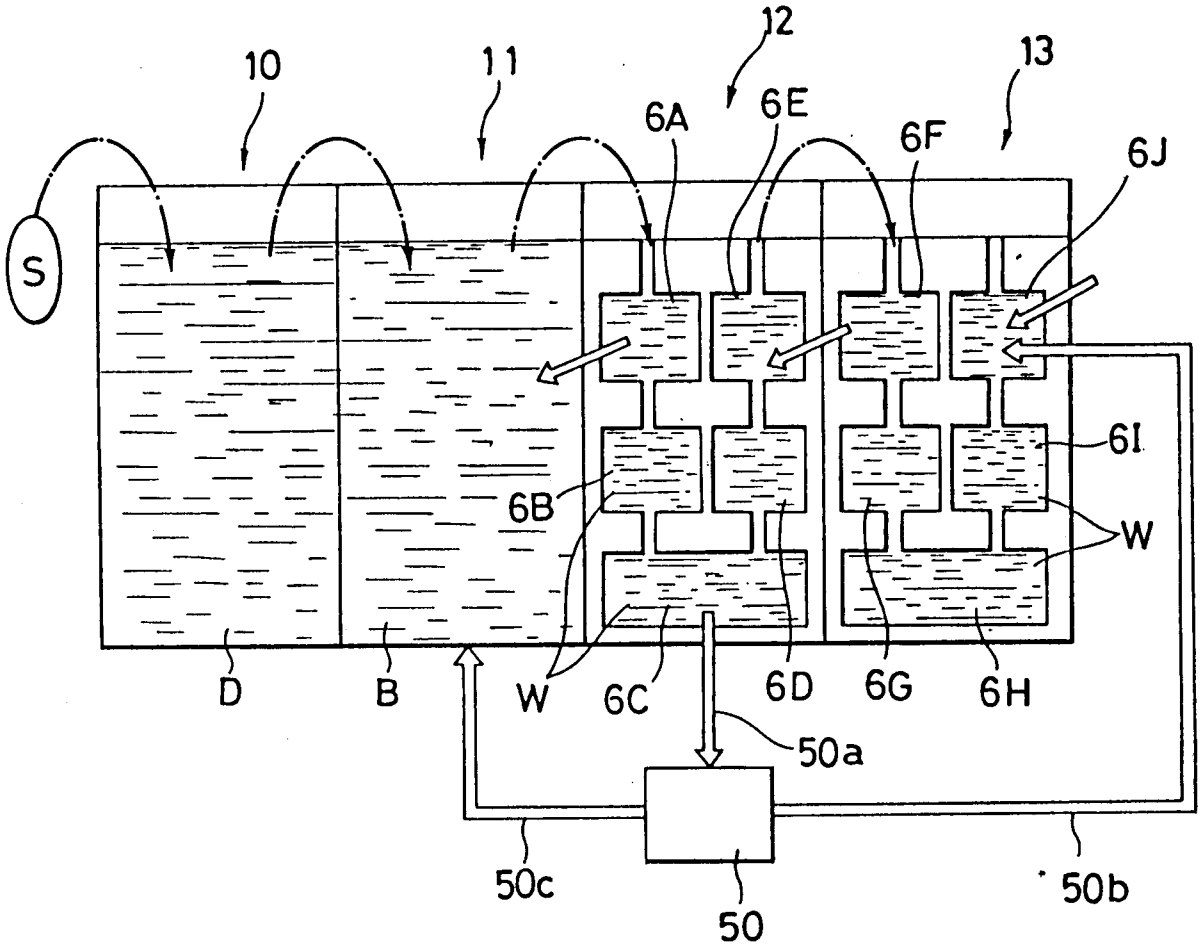

The embodiment of FIG. 12 has substantially the same recycle system as FIG. 11 except that the water in intermediate compartment 6C of first wash tank 12 is drained to reverse osmosis unit 50.

Although a single wash tank is installed in FIG. 5 and two wash tanks are installed in FIGS. 9 to 12, the number of wash tanks is not critical to the invention. The preferred number of wash tanks, which largely depends on the number and volume of compartments therein, is generally from one to three.

Although the overflow from entrance compartment 6A of first wash tank 12 is of a substantially smaller amount than the replenisher water in these embodiments, it is preferred to recycle such a small amount of overflow to the preceding stage tank. The embodiments of FIGS. 11 and 12 are preferred in this respect.

Referring to FIG. 13, a wash tank is illustrated as embodying a processing apparatus in the fifth form of the invention.

This wash tank is of substantially the same configuration as those of FIGS. 1 and 6. The difference is the provision of gas bubbling means 15 coupled to the intermediate compartment 6C for delivering bubbles of an inert gas, for example, nitrogen gas into the wash water W. The gas bubbling means 15 is oriented so as to inject bubbles of nitrogen gas in a direction opposite to the travel direction of photosensitive strip S being washed (or processed), that is, vertically upward. The gas bubbling means 15 includes a nozzle 151 extending into the intermediate compartment 6C, a source of nitrogen gas in the form of a bomb 155, and a tube 153 connecting the nozzle 151 to the bomb 155. The nozzle 151 tip is preferably positioned adjacent the path for photosensitive strip S and near the entrance defined between the intermediate compartment 6C and the channel 72 and angled vertically upward so that bubbles of nitrogen gas may be injected into the intermediate compartment 6C toward photosensitive strip S. The bubbles will rise through the intermediate compartment 6C, narrow channel 72, compartment 6B, narrow channel 71 and entrance compartment 6A. Since it is preferred that nitrogen gas be bubbled against the emulsion side of photosensitive strip S, the photosensitive strip S is carried into the wash tank with its emulsion side faced down in the illustrated embodiment. Better results are obtained by bubbling nitrogen gas against the emulsion side of photosensitive strip S.

The nozzle 151 at the tip may have 1 to 50 orifices per square centimeter each having an average diameter of 0.05 to 1 mm. The nozzle orifices are arranged in a transverse direction of photosensitive strip S.

The nozzle 151 is preferably positioned such that its orifices are arranged near the entrance defined between the intermediate compartment 6C and the channel 72 as described above. This can prevent bubbles from migrating to the left in the figure, that is, to compartments 6D, 6E and channels 73, 74. Entry of nitrogen gas bubbles into the exit side is undesirable.

Nitrogen gas is bubbled under sufficient conditions for bubbles to reach the entrance compartment 6A, for example, under a pressure of about 0.05 to about 1 kg/cm$^2$ and at a flow rate of about 50 to about 800 ml/min.

Now assume that washing is started by carrying a photosensitive strip S into the wash tank. At the same time, supply of fresh water as a replenisher for the wash water W to the exit compartment 6E through the inlet port 21 and injection of nitrogen gas bubbles into the intermediate compartment 6C through the nozzle 151 are started.

The photosensitive strip S is sequentially passed through compartments 6A, 6B, 6C, 6D, and 6E while it is washed with water. During the process, nitrogen gas bubbles are injected through the nozzle 151 toward the photosensitive strip S and move vertically upward along the emulsion side of photosensitive strip S.

On entry into the wash tank, the photosensitive strip S has the processing solution of the preceding tank (e.g., bleach-fixing or fixing tank) adhered to the emulsion side thereof, with the thin solution layer forming a double layer at the interface with the emulsion layer. Water washing is done on the emulsion layer having such a double layer formed thereon. Bubbling of nitrogen gas breaks and removes the thin solution layer and the double layer. As the photosensitive strip S passes through the narrow channels, the thin solution layer and the double layer are effectively broken and removed. With the thin solution layer and the double layer removed from the emulsion layer surface, the residual chemicals are effectively washed away from the emulsion layer. Therefore, washing efficiency is further improved by the nitrogen gas bubbling. In general, the narrower and the longer the channels, the more is the bubbling effect. In this respect, the preferred channels have a gap distance of about 0.3 to 20 mm, more preferably about 0.5 to 5 mm and a length of about 3 to 200 mm, more preferably about 10 to 100 mm.

It is to be noted that upon bubbling of nitrogen gas, the amount of wash water transferred between adjoining compartments in the first half of the continuous processing path remains approximately unchanged from that occurring in the absence of bubbling, that is, in the range of about 1 to about 100 ml/min. However, by bubbling nitrogen gas into the intermediate compartment 6C, the movement of wash water is promoted by the rising bubbles in and between compartments 6C–6B and 6B–6A during washing (or processing). Relatively fresh wash water is likely to move into the compartments 6B and 6A, also resulting in an increased washing efficiency.

Although the transfer of wash water in the travel direction of photosensitive strip S during processing is considered negligible, such an entrainment is not completely zero. Bubbling of nitrogen gas can also eliminate such an undesirable entrainment.

Since the wash water is allowed for little passage between adjoining compartments in the absence of nitrogen gas bubbling, the chemicals carried in from the preceding tank by the photosensitive strip S are present at the highest concentration in the entrance compartment 6A and their concentration sequentially lowers from the entrance compartment 6A to the exit compartment 6E. Differential concentrations are maintained in the compartments 6A to 6E during processing to ensure an increased washing efficiency. This was observed in U.S. Ser. No. 340,820. In the preferred embodiment of FIG. 13, the differential concentrations are maintained in more preferable proportions, with more improved washing efficiency.

As the washing is completed in this way, the photosensitive strip S is carried out of the wash tank.

Although nitrogen gas is used as the gas inert to wash water, any other inert gases such as helium, neon, and argon gases may be used as long as they do not have deleterious effect on the essential function of wash water for washing the photosensitive material. Deoxygenated air may be used in some cases, and air can be used if the path for forcedly circulating the wash water transversely through the compartment is provided with means for removing deposits.

Instead of supplying nitrogen gas from the nitrogen gas source 155, it is possible to introduce air into the used developer. Oxygen can be removed from the air by utilizing the residual reducing force the used developer possesses. The thus deoxygenated air (that is, substantial nitrogen) is then bubbled into the wash water through the nozzle 151.

When a large quantity or area of photosensitive material is washed (or processed), air can be bubbled with a likelihood that silver sulfide can form. Then filters are preferably positioned in the flowpaths for forcedly circulating the wash water transversely through the compartments 6A and 6B, thereby removing any deposits from the wash water through the filters.

Although the nozzle 151 is positioned near the entrance between the intermediate compartment 6C and the narrow channel 72 in the illustrated embodiment of FIG. 13, the nozzle position is not limited thereto. The nozzle can be located at any desired position as long as bubbles can be delivered in an opposite direction to the travel direction of photosensitive material along the continuous processing path comprising compartments serially connected through narrow channels.

To obtain the benefit of removing a thin layer of the preceding tank solution and a double layer associated therewith, it is sufficient to position the nozzle so as to deliver bubbles along the first half of the continuous processing path. Such positioning of the nozzle is also preferred for operation, overall apparatus design, and nitrogen gas consumption. The first half of the continuous processing path is generally determined with respect to the position where the photosensitive material reverses its travel direction in the wash tank. Therefore, the first half of the continuous processing path extends from the entrance where the photosensitive material is carried into the wash water to the reversal position.

In the wash tank illustrated in FIG. 13, the nozzle 151 is preferably positioned within the intermediate compartment 6C so that bubbles will move upward therefrom through the compartments 6B and 6A. The particular position and angle of the nozzle 151 in the intermediate compartment 6C is not limited insofar as provision is made so as to prevent entry of bubbles to the second half of the path, that is, channels 73, 74 and compartments 6D, 6E. If desired, a barrier may be provided in the intermediate compartment 6C to prevent lateral escape of bubbles.

Although the wash tank has been described as a preferred embodiment of the invention, a processing tank having gas bubbling means 15 is applicable as any desired processing tank.

For example, the gas bubbling concept may be applied to a stabilizing tank. This is achieved by substituting a stabilizing solution for the wash water in the foregoing embodiment. Equivalent effects are exerted for the same reasons as in the case of wash water.

Also, the gas bubbling concept may be applied to bleach-fixing, fixing and bleaching tanks without an essential difference from the washing tank, except that the flow direction of processing solution plus replenisher is opposite to the flow direction of wash water in the wash tank. Bubbling may be done in the first half of the continuous processing path where compartments are connected through narrow channels. The gas to be bubbled may be suitably selected, for example, an inert gas in the fixing tank, air in the bleaching tank, and an inert gas in the bleach-fixing tank.

More particularly, the following changes are made in the embodiment of FIG. 13. The processing solution contained in the tank is replaced by a bleach-fixing solution, fixing solution or bleaching solution. The port 22 which has been a drain port in the wash tank is used as an inlet port. The port 21 which has been an inlet port in the wash tank is used as a drain port. The flow direction of processing solution is made identical to the travel direction of photosensitive strip S (parallel flow relative to strip S). In such a processing tank, the differential concentrations or concentration gradients of chemical agents in a desired direction among the compartments are not so positively maintained as in the wash tank. Since the processing solution is also carried into such a processing tank from the preceding tank (e.g., developing tank), the effect of breaking and removing a thin solution layer adhered to the photosensitive material or an interfacial double layer associated therewith such that unnecessary or waste components are effectively washed away from the emulsion layer is significant. The gas to be bubbled in such a processing tank also includes nitrogen, helium, neon, and argon gases as well as deoxygenated air and air as the case may be. Any suitable gas may be selected for a particular application as previously described. If the tank is a bleaching or bleach-fixing tank through which a large quantity or area of photosensitive material is processed, then air can be bubbled.

If the gas bubbling concept is applied to the developing tank which is a first tank in the continuous process, the tank construction may be the same as in the case of the bleach-fixing tank because the flow direction of processing solution is the same, with the exception that the processing solution is changed to a developer. Mostly, the problem of drag-out or carry-in of the preceding tank solution by the photosensitive material does not arise in the developing tank. Nevertheless, reacted or exhausted wastes are produced during development in the first half of the continuous developing path and such wastes can adhere to the emulsion surface of photosensitive material. Injection of gas bubbles can remove such wastes from the emulsion surface of photosensitive material, thereby promoting development. The problem of drag-out or carry-in of the preceding tank solution by the photosensitive material can arise in the developing tank if it is used in the reversal process. Then the same effect is exerted as in the bleach-fixing tank for the same reason. The gas to be bubbled in the developing tank may also be selected from nitrogen, helium, neon, and argon gases as well as deoxygenated air. The use of air as such is prohibited in this case.

Next, the processing solution filled in the processing tank of the invention will be described.

Wash water used in the wash tank may be city water, deionized water and other cleaned water. The wash water may contain any well-known additives if desired. The additives include chelating agents such as inorganic phosphoric acid, aminopolycarboxylic acid, and organic phosphoric acids, bactericides and fungicides for preventing the growth of various bacteria and algae, hardeners such as magnesium and aluminum salts, and surface-active agents for preventing drying marks. Also included are the compounds described in L. E. West "Water Quality Criteria," Phot. Sci. and Eng., Vol. 9, No. 6, 344–359 (1965).

The stabilizing solution used herein is a solution for stabilizing dye images. For example, buffer solutions at pH 3 to 6 and solutions containing aldehydes such as formalin may be used. If desired, the stabilizing solution may contain any desired additives, for example, a brightener, chelating agent, bactericide, fungicide, hardener, and surface-active agent.

The black-and-white developer used herein contains well-known developing agents alone or mixtures thereof, for example, dihydroxybenzenes (such as hydroquinone), 3-pyrazolidones (such as 1-phenyl-3-pyrazolidone), and p-aminophenols (such as N-methyl-p-aminophenol).

The color developer used herein is generally an aqueous alkaline solution containing a color developing agent. The color developing agents include well-known primary aromatic amine developing agents, for example, phenylenediamines such as 4-amino-N,N-diethylaniline, 3-methyl-4-amino-N,N-diethyl-aniline, 4-amino-N ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamideethylaniline, and 4-amino-3-methyl-N-ethyl-N-$\beta$-methoxyethylaniline. The developer may further contain pH buffer agents, development restrainers and antifoggants such as carbonates, borates and phosphates of alkali metals. If desired, the developer may contain water softeners, preservatives, organic solvents, development. promoters, dye-forming couplers, competitive couplers, fogging agents, auxiliary developing agents, thickeners, polycarboxylic acid chelating agents, antioxidants, alkali agents, dissolving aids, surface-active agents, and debubbling agents.

The fixing or bleach-fixing solution used herein contains a fixing agent. The fixing agents include ammonium thiosulfate, sodium thiosulfate known as hypo, ammonium halides, thiourea, and thioethers. The bleach-fixing solution additionally contains a bleaching agent which is generally selected from iron salts of polycarboxylic acids, potassium ferricyanide, bromates, and cobalt hexamines. Preferred among them are potassium ferricyanide, sodium iron (III) ethylenediaminetetraacetate, and ammonium iron (III) ethylenediaminetetraacetate.

In addition to the fixing agent, the fixing or bleach-fixing solution contains fixing aids such as preservatives (e.g., sodium sulfite), acid agents, buffer agents, and hardeners. It may further contain a bleaching promoter as disclosed in U.S. Pat. Nos. 3,042,520 and 3,241,966 and Japanese Patent Publication (JP-B) Nos. 8506/1970 and 8636/1970, a thiol compound as disclosed in JP-A No. 65732/1978, and other additives.

The type of photosensitive material which can be processed in the apparatus of the invention is not particularly limited. Any desired types of photosensitive material may be processed, including color negative film, color reversal film, color photographic paper, color positive film, color reversal photographic paper, printing photographic photosensitive material, radiographic photosensitive material, black-and-white negative film, black-and-white photographic paper, and micro-film photosensitive material.

The photosensitive material processing apparatus of the invention will find a variety of uses such as wet copying machines, automatic developing machines, printer processors, video printer processors, photographic print producing vending machines, and proof color paper processors.

The photosensitive material processing apparatus of the invention has great benefits of a size reduction, efficient processing, and processing solution saving.

In the apparatus of the invention, a plurality of processing compartments are serially connected through narrow channels to define a continuous processing path and differential concentrations of chemicals are maintained among the compartments in accordance with the flow direction of processing solution. As a result, the apparatus can improve processing efficiency while achieving a size reduction.

In the first form, the first compartment to which the processing solution is first supplied has a smaller volume than the remaining compartments. Upon restart of processing operation after a certain quiescent period, the processing solution in this smaller volume compartment is immediately displaced by fresh solution so that a lowering of processing efficiency immediately after the restart is avoided.

In the second form, the compartment to which the processing solution is first supplied is substantially emptied of the processing solution during a quiescent period. Processing operation can be restarted at the end of the quiescent period simply by filling the then empty compartment again with fresh solution, so that a lowering of processing efficiency immediately after the restart is avoided.

In the third form, the wash water in a lower compartment which is located at a vertically lower position of the continuous processing path is drained at the end of processing. Washing operation can be restarted simply by filling fresh water in an amount corresponding to the drainage. The restarting operation is simple and efficient washing is ensured. Also, a lowering of washing efficiency immediately after the restart is avoided.

In the fourth form, used water is separated into a concentrate portion and a dilute portion which is fed back to the wash tank so that a saving of wash water is achieved. In preferred embodiments, the concentrate portion is recycled to the processing solution of the preceding stage, for example, the blix solution so that the amount of the blix solution replenished may be reduced. Also, an increased silver recovery rate is expectable and the processing time becomes short.

In the fifth form, bubbles of an inert gas are injected against the photosensitive material in a counter flow with respect to the travel direction of photosensitive material. Processing efficiency, especially washing efficiency is significantly improved. The amount of processing solution, especially wash-water used can be reduced.

EXAMPLE

Various experiments were carried out to demonstrate how efficiently the processing apparatus of the invention performed. Some are described below.

EXAMPLE 1

Using a wash tank of the configuration illustrated in FIG. 1, a strip of color paper, Fuji Color Paper CLP-03 manufactured by Fuji Photo-Film Co., Ltd., which had been suitably processed, was washed with water. In the wash tank, the compartments 6A to 6D each had a volume of about 1,000 ml and the exit compartment 6E had a volume of about 200 ml. Fresh water was replenished in an amount of 360 ml per square meter of the color paper. This is designated Procedure 1A.

Procedure 1A was changed in that the exit compartment 6E had the same volume as each of the remaining compartments 6A to 6D. Fresh water was replenished in an amount of 360 ml per square meter of the color paper. This is designated Procedure 1B.

The overall schedule involved processing (washing) 6.9 $m^2$ of color paper according to Procedures 1A and 1B, interrupting the operation for a certain quiescent period (one day), and restarting the operation. The time taken until stable processing was resumed after the restart was measured. The results are:

Procedure 1A 10 minutes

Procedure 1B 50 minutes.

Procedures 1A and 1B were repeated except that the exit compartment 6E was emptied after the interruption and refilled with fresh water immediately before the restart. These procedures are designated Procedures 1C and 1D.

Procedure 1B was repeated except that the volume of wash water in the lowermost compartment 60C was drained during the quiescent period as shown in FIG. 4 and the empty compartments were refilled with fresh water immediately before the restart. This procedure is designated Procedure 1E.

The time taken until stable processing was resumed after the restart was measured. The results are:

Procedure 1C 7.4 minutes

Procedure 1D 37 minutes

Procedure 1E 45 minutes.

These results demonstrate the effectiveness of the first to third forms of the invention.

EXAMPLE 2

A strip of color paper, Fuji Color Paper Type 2 manufactured by Fuji Photo-Film Co., Ltd., was processed using a processor of the arrangement shown in FIG. 5 having a wash tank of the configuration shown in FIG. 6. The color paper strip, which had been exposed, was developed with a color developer PQ1 of formulation CP-25Q at 38° C. for 100 seconds, bleach-fixed with a bleach-fixing agent PQ2 at 30°-34° C., and thereafter washed with water at 27°-33° C. All the agents used were manufactured by Fuji Photo-Film Co., Ltd.

The developing tank was of the conventional structure. The bleach-fixing and washing tanks had a plurality of compartments according to the invention. Their number and volume are shown below.

| Tank | Number of compartments | Volume per compartment | Total volume |
|---|---|---|---|
| Developer | 1 | — | 60,000 ml |
| Blix | 11 | 150 | 1,650 ml |
| Wash | 11 | 150 | 1,650 ml |

The means 50 for separating used water into concentrate and dilute portions was a reverse osmosis (RO) unit as previously specified.

The aerator 55 was of the structure shown in FIG. 7. The porous cylindrical member contained pores with a diameter of 0.3 to 1 μm. Air was introduced under a pressure of about 1.05 atmospheres at a flow rate of 1 liter/min.

The washing time was set to be 45 seconds. The running operation was carried out such that the quantity of developer in the developing tank was replaced twice a day.

This procedure is designated Procedure 2A.

Procedure 2A was repeated except that the aerator was omitted from the recycle system. This is designated Procedure 2B.

Procedure 2A was repeated except that the separator (RO unit) and the aerator were omitted. This is designated Procedure 2C.

Procedure 2A was repeated except that the processing tank was replaced by those disclosed in FIGS. 1 and 2 of JP-A No. 105150/1983. The washing time was set to be 120 seconds. The procedures using the tanks of FIGS. 1 and 2 are designated Procedures 2D and 2E, respectively.

The results are shown in Table 1.

TABLE 1

| Procedure | 2A | 2B | 2C* | 2D* | 2E* |
|---|---|---|---|---|---|
| Wash | | | | | |
| Volume per tank, liter | 1.65 | 1.65 | 1.65 | 20 | 20 |
| Replenishment, ml | 10 | 10 | 24 | 40 | 400 |
| Number of tanks | 2 | 2 | 2 | 5 | 5 |
| Blix | | | | | |
| Volume, liter | 1.65 | 1.65 | 1.65 | 20 | 20 |
| Replenishment, ml | 10 | 10 | 14 | 16 | 20 |
| Time, sec. | 40–44 | 44–47 | 47–50 | 50–55 | 60–65 |
| Silver recovery, % | 99.99 | 99.99 | 99.4 | 99.9 | 98 |
| RO operating pressure, kg/cm$^2$ | 10–20 | 10–20 | — | 40–50 | — |

In Table 1, the "volume" is the volume of wash water or blix solution initially charged in each tank, and the "replenishment" is the volume of wash water or blix solution replenished per 8.25 cm×1 m of color paper. Procedures 2C, 2D and 2E are outside the scope of the invention.

As seen from Table 1, Procedures 2A and 2B according to the invention could significantly reduce the amount of wash water replenished. Also, the reverse osmosis (RO) unit could be operated at a lower pressure.

In addition, satisfactory photographic properties were obtained without problems of short desilvering, short washing, and deficient color restoration although the times for both bleach-fixing and washing and the amounts of bleach-fixing solution and wash water replenished were reduced.

EXAMPLE 3

Procedures 2A and 2B of Example 2 were repeated except that the reverse osmosis (RO) unit used as the separating means was replaced by an evaporation/condensation separator of the configuration shown in FIG. 8. Equivalent results were obtained.

EXAMPLE 4

A multi-layer photographic color paper sheet was prepared from a paper support having both sides laminated with polyethylene by coating it with the following coating compositions in the layer arrangement shown below.

The coating composition was prepared as follows.

Preparation of first layer coating composition

In 27.2 ml of ethyl acetate and 7.7 ml (8.0 grams) of high-boiling solvent (Solv-1) were dissolved 19.1 grams of yellow coupler (ExY-1) and 4.4 grams of color image stabilizer (Cpd-1). The solution was dispersed and emulsified in 185 ml of 10% gelatin aqueous solution containing 8 ml of 10% sodium dodecylbenzene sulfonate solution. The emulsified dispersion was mixed with emulsions EM1 and EM2. The resulting solution was adjusted for gelatin concentration so as to give the composition shown below, obtaining a first layer coating composition.

Coating compositions for second to seventh layers were prepared by substantially the same procedure.

The gelatin hardener used in each layer was 1-oxy-3,5-dichloro-s-triazine sodium salt. The thickener used was (Cpd-2).

Layer arrangement

Each of the layers has the composition shown below. That is, ingredients and their amounts coated are shown below for each layer. The amount of each ingredient coated is expressed in gram per square meter (g/m$^2$) unit except that the amount of silver halide coated is expressed by calculating the amount of silver coated.

Support

Polyethylene laminated paper with the polyethylene layer on the first layer side containing white pigment ($TiO_2$) and a blue-tinting dye.

| | |
|---|---|
| First layer: blue-sensitive layer | |
| Monodispersed silver chloride emulsion (EM1) spectrally sensitized with sensitizing dye (ExS-1) | 0.15 |
| Monodispersed silver chloride emulsion (EM2) spectrally sensitized with sensitizing dye (ExS-1) | 0.15 |
| Gelatin | 1.86 |
| Yellow coupler (ExY-1) | 0.82 |
| Color image stabilizer (Cpd-2) | 0.19 |
| Solvent (Solv-1) | 0.35 |
| Second layer: Anti-color-mixing layer | |
| Gelatin | 0.99 |
| Anti-color-mixing agent (Cpd-3) | 0.08 |
| Third layer: green-sensitive layer | |
| Monodispersed silver chloride emulsion (EM3) spectrally sensitized with sensitizing dyes (ExS-2) and (ExS-3) | 0.12 |
| Monodispersed silver chloride emulsion (EM4) spectrally sensitized with sensitizing dyes (ExS-2) and (ExS-3) | 0.24 |
| Gelatin | 1.24 |
| Magenta coupler (ExM-1) | 0.39 |
| Color image stabilizer (Cpd-4) | 0.25 |
| Color image stabilizer (Cpd-5) | 0.12 |
| Solvent (Solv-2) | 0.25 |
| Fourth layer: UV absorbing layer | |
| Gelatin | 1.60 |
| UV absorbers (Cpd-6/Cpd-7/Cd-8 = 3/2/6 in weight ratio) | 0.70 |
| Anti-color-mixing agent (Cpd-9) | 0.05 |
| Solvent (Solv-3) | 0.42 |
| Fifth layer: red-sensitive layer | |
| Monodispersed silver chloride emulsion (EM5) spectrally sensitized with sensitizing dyes (ExS-4) and (ExS-5) | 0.07 |
| Monodispersed silver chloride emulsion (EM6) spectrally sensitized with sensitizing dyes (ExS-4) and (ExS-5) | 0.16 |

-continued

| | |
|---|---|
| Gelatin | 0.92 |
| Cyan coupler (ExC-1) | 1.46 |
| Cyan coupler (ExC-2) | 1.84 |
| Color image stabilizers (Cpd-7/Cpd-8/Cd-10 = 3/4/2 in weight ratio) | 0.17 |
| Dispersing polymer (Cpd-11) | 0.14 |
| Solvent (Solv-1) | 0.20 |
| Sixth layer: UV absorbing layer | |
| Gelatin | 0.54 |
| UV absorbers (Cpd-6/Cpd-8/Cd-10 = 1/5/3 in weight ratio) | 0.21 |
| Solvent (Solv-4) | 0.08 |
| Seventh layer: protective layer | |
| Gelatin | 1.33 |
| Acryl-modified polyvinyl alcohol copolymer (modification 17%) | 0.17 |
| Liquid paraffin | 0.03 |

The anti-irradiation dyes used were (Cpd-12) and (Cpd-13). Each photosensitive layer further contained Alkanol XC (manufactured by E. I. duPont) and sodium alkylbenzene sulfonate as emulsification/dispersion aids, and succinate ester and Magefacx F-120 (manufactured by Dai-Nihon Ink K.K.) as coating aids. Stabilizers (Cpd-14) and (Cpd-15) were used for stabilizing silver halide.

The emulsions used had the following characteristics.

| Designation | Shape | Grain size (μ) | Br content (mol %) | Coefficient of variation |
|---|---|---|---|---|
| EM1 | cubic | 1.1 | 1.0 | 0.10 |
| EM2 | cubic | 0.8 | 1.0 | 0.10 |
| EM3 | cubic | 0.45 | 1.5 | 0.09 |
| EM4 | cubic | 0.34 | 1.5 | 0.09 |
| EM5 | cubic | 0.45 | 1.5 | 0.09 |
| EM6 | cubic | 0.34 | 1.6 | 0.10 |

*The coefficient of variation is the standard deviation divided by the average grain size, which represents the grain distribution.

The compounds used in this example are identified below.

ExY-1

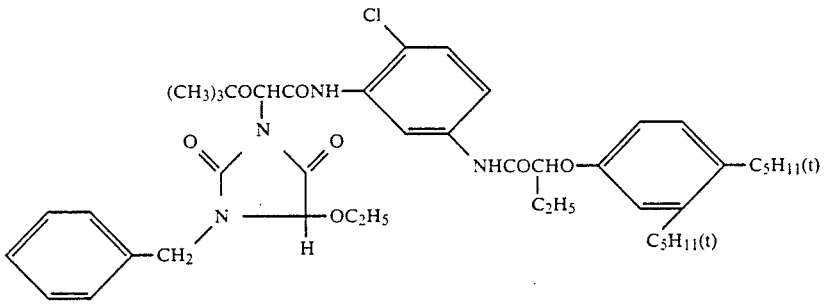

ExM-1

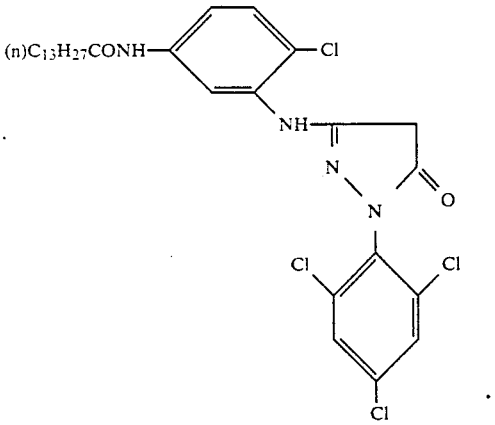

ExC-1

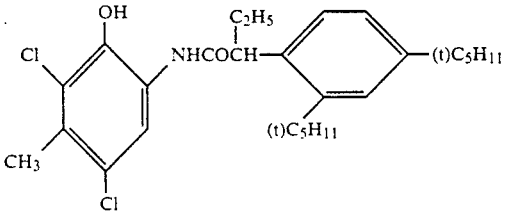

-continued
ExC-2
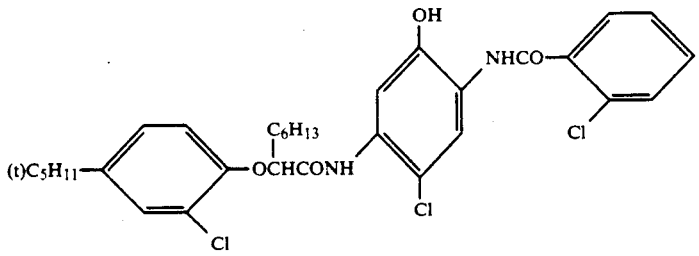
ExS-1
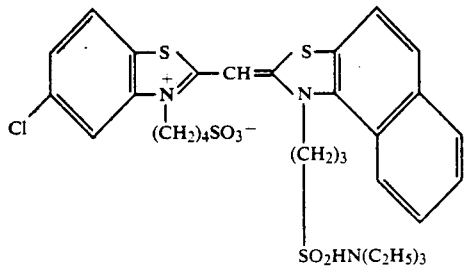
ExS-2
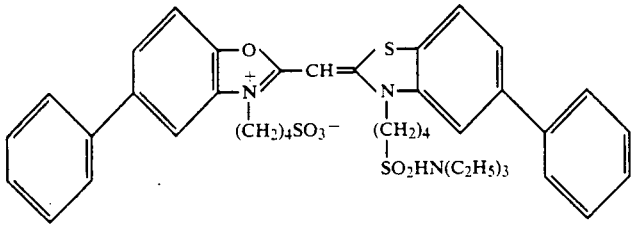
ExS-3
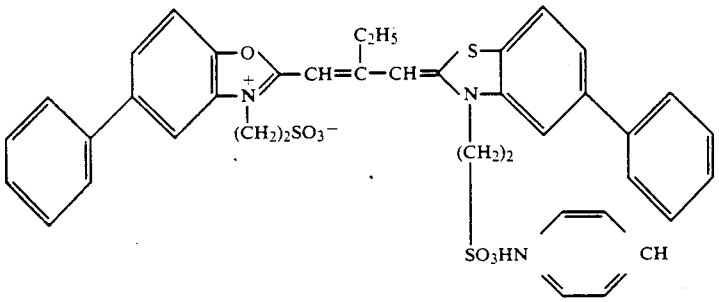
ExS-4
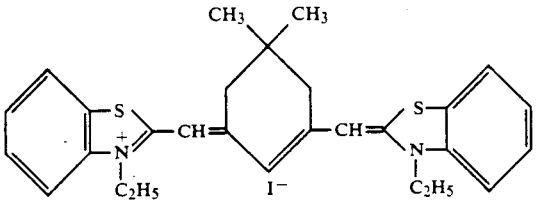
ExS-5
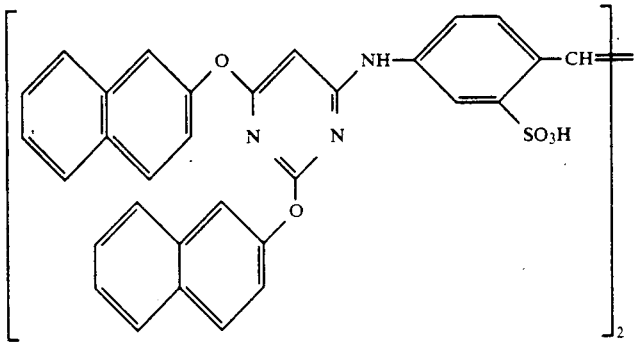

-continued
Cpd-1
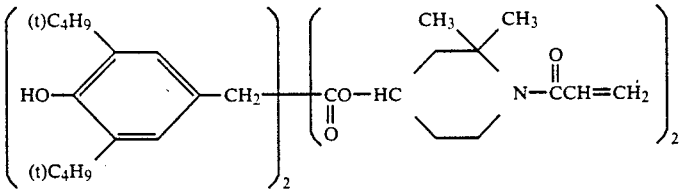
Cpd-2
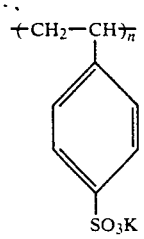
Cpd-3
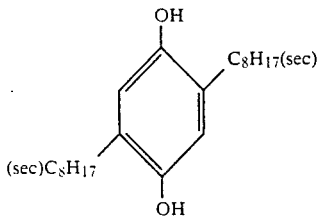
Cpd-4
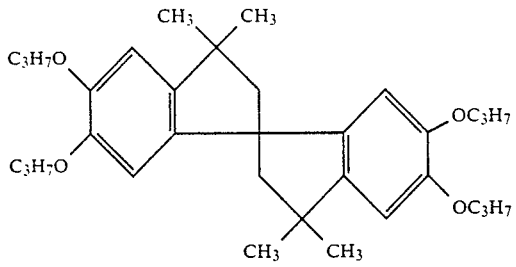
Cpd-5
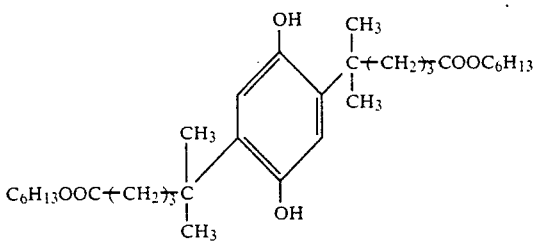
Cpd-6
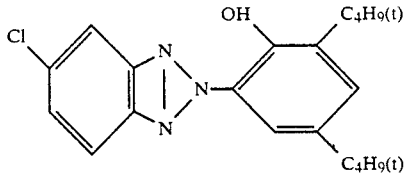
Cpd-7
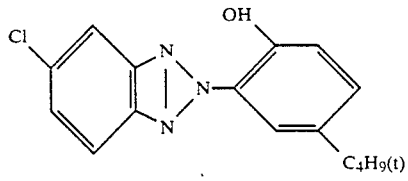

-continued
Cpd-8
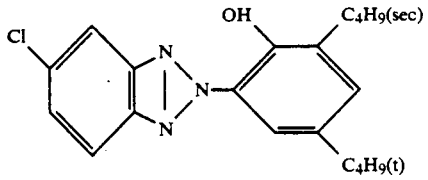
Cpd-9
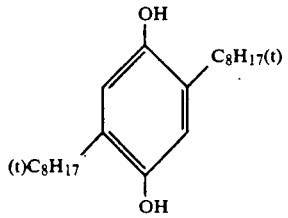
Cpd-10
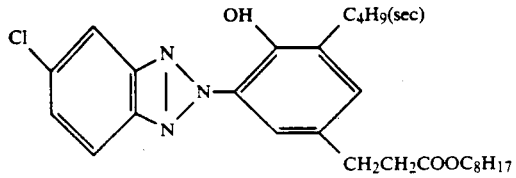
Cpd-11
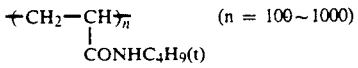
Cpd-12
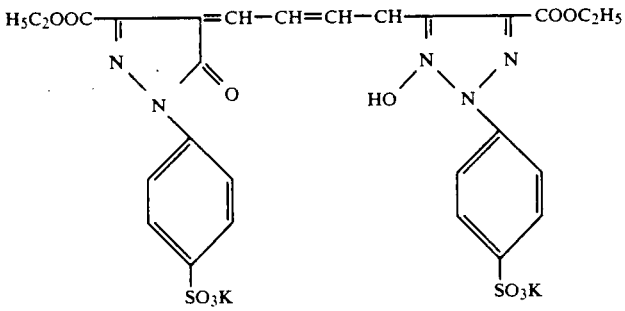
Cpd-13
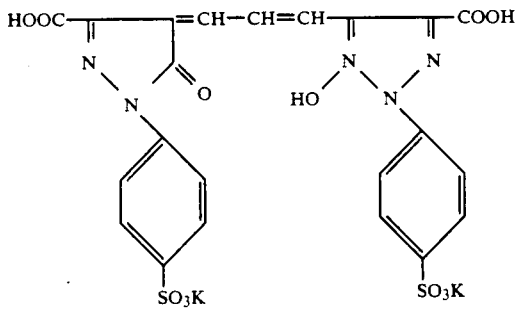
Cpd-14
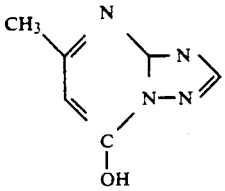
Cpd-15
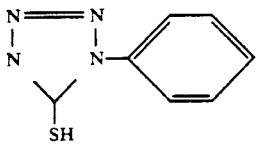

Solv-1: dibutyl phthalate
Solv-2: trioctyl phosphate
Solv-3: trinonyl phosphate
Solv-4: tricresyl phosphate The above-prepared photosensitive material was exposed imagewise, and then subjected to a running test including a series of continuous steps for color development in the following order.

| Processing steps | Temperature | Time | Replenisher amount* | Tank volume |
|---|---|---|---|---|
| Color development | 35° C. | 45" | 161 ml | 17 liters |
| Bleach-fix | 30-36° C. | 45" | 161 ml | 17 liters |
| Wash (1) | 30-37° C. | 30" | — | 10 liters |
| Wash (2) | 30-37° C. | 30" | — | 10 liters |
| Wash (3) | 30-37° C. | 30" | 360 ml | 10 liters |
| Drying | 70-80° C. | 60" | | |

*Volume of solution replenished per square meter of the photosensitive material. For rinsing, wash water was passed through three tanks in a counterflow mode from tank (3) to (2) to (1).

Each processing solution had the following composition.

| Color Developing solution | | |
|---|---|---|
| Ingredients | Mother | Replenisher |
| Water | 800 ml | 800 ml |
| Ethylenediamine-N,N,N,N-tetramethylene phosphonic acid | 1.5 g | 1.5 g |
| Triethylenediamine-1,4-diazabicyclo-(2,2,2)octane | 5.0 g | 5.0 g |
| Sodium chloride | 1.4 g | |
| Potassium carbonate | 25 g | 25 g |
| N-ethyl-N-(β-methanesulfonamideethyl)-3-methyl-4-aminoaniline hydrogen sulfate | 5.0 g | 7.0 g |
| Diethylhydroxylamine | 4.2 g | 6.0 g |
| Brightener (4,4'-diaminostilbene) | 2.0 g | 2.5 g |
| Water totaling to | 1000 ml | 1000 ml |
| pH (25° C.) | 10.05 | 10.45 |

| Bleach-fix solution | |
|---|---|
| Ingredients | Mother/Replenisher |
| Water | 400 ml |
| Ammonium thiosulfate (70%) | 100 ml |
| Ammonium sulfite | 17 g |
| Ammonium iron (III) ethylenediamine tetraacetate | 55 g |
| Disodium ethylenediamine tetraacetate | 5 g |
| Ammonium bromide | 40 g |
| Glacial acetic acid | 9 g |
| Water totaling to | 1000 ml |
| pH (25° C.) | 5.40 |

Wash water (mother/replenisher)

Ion-exchanged water (calcium and magnesium contents each up to 3 ppm)

This procedure is designated Procedure 4A.

Procedure 4A was repeated except that a single wash tank of the configuration shown in FIG. 6 (without the drain port 23 in the lowermost compartment) was used instead of the three wash tanks used in Procedure 4A. This procedure is designated Procedure 4B.

Procedure 4B (using a multiple compartment wash tank of FIG. 6) was repeated by utilizing a tank arrangement and a solution flow sequence as shown in FIG. 5, 9, 10, 11 or 12 and incorporating the same reverse osmosis (RO) unit as used in Example 2. These procedures are designated Procedures 4C through 4G. The developing and bleach-fixing tanks used in Procedures 4C to 4G were the same as in Procedures 4A and 4B. The washing time of Procedures 4B to 4G is shown in Table 2.

The wash tank shown in FIG. 6 contained five compartments each having a volume of 260 ml. The amount of wash water moving between adjoining compartments was about 0.1 ml/min. during a quiescent period and about 20 ml/min. during operation.

The amounts of wash water and bleach-fixing solution replenished in Procedures 4A to 4G were shown in Table 2 together with the total amount replenished.

TABLE 2

| Procedure | Washing time | Replenishment Water | Blix | Total |
|---|---|---|---|---|
| 4A* | 90 sec. | 360 ml/m$^2$ | 161 ml/m$^2$ | 521 ml/m$^2$ |
| 4B* | 73 sec. | 180 ml/m$^2$ | 161 ml/m$^2$ | 341 ml/m$^2$ |
| 4C | 65 sec. | 60 ml/m$^2$ | 137 ml/m$^2$ | 197 ml/m$^2$ |
| 4D | 63 sec. | 40 ml/m$^2$ | 137 ml/m$^2$ | 177 ml/m$^2$ |
| 4E | 60 sec. | 40 ml/m$^2$ | 161 ml/m$^2$ | 201 ml/m$^2$ |
| 4F | 60 sec. | 40 ml/m$^2$ | 120 ml/m$^2$ | 160 ml/m$^2$ |
| 4G | 60 sec. | 40 ml/m$^2$ | 120 ml/m$^2$ | 160 ml/m$^2$ |

*outside the scope of the invention

As seen from Table 2, Procedures 4C to 4G according to the invention can achieve a significant reduction of the amount of wash water replenished and the washing time.

A comparison of Procedure 4D using the processor of FIG. 9 with Procedure 4F using the processor of FIG. 11 revealed that the life of the diaphragm in the reverse osmosis (RO) unit during Procedure 4F was extended about 1.3 to 4 times that during Procedure 4D. Such an extension of the reverse osmosis diaphragm life became more evident when a similar comparison was made by applying the recycle system to the first stage wash tank, that is, wash tank 12 rather than the second stage wash tank.

In addition, satisfactory photographic properties were obtained as in Example 2 without short desilvering or short washing although the times for both bleach-fixing and washing and the amounts of bleach fixing solution and wash water replenished could be reduced. Silver recovery rate was also increased as in Example 2.

The results of Examples 2 to 4 demonstrate the effectiveness of the third form of the invention.

EXAMPLE 5

A strip of photosensitive material, Fuji Color Super HR Paper manufactured by Fuji Photo-Film Co., Ltd. was suitably processed and then washed with water in a wash tank having the configuration shown in FIG. 13.

The wash tank contained five compartments each having a volume of 600 ml. The narrow channels each had a gap of 3 mm and a longitudinal distance of 30 mm between the adjoining compartments. Wash water was replenished in an amount of 273 ml/m$^2$ of the color paper.

A nozzle was provided in the lowermost compartment 6C as shown in FIG. 13 to bubble nitrogen gas into the wash water and against the color paper. Nitrogen gas bubbling conditions included

| | |
|---|---|
| pressure | 0.2 kg/cm$^2$ |
| flow rate | 120 ml/min. |
| average orifice diameter | 0.3 mm |
| orifice density | 12 orifices/cm$^2$. |

The nozzle was provided with orifices arranged in a transverse direction of the color paper being washed.

The color paper was washed while nitrogen gas bubbles moved upward therealong. Washing was effected for 60 seconds with ion exchanged water at 34° C. The amount of wash water moving between adjoining compartments was about 0.1 ml/min. during a quiescent period and the amount of wash water moved with the travel of color paper was about 13 to 16 ml/min. during operation.

This is designated Procedure 5A.

Washing was repeated according to Procedure 5A except that the amount of water replenished was increased to 364 ml/m$^2$ and the nitrogen gas nozzle was omitted. The amount of wash water moving between adjoining compartments was about 0.1 ml/min. during a quiescent period and the amount of wash water moved with the travel of color paper was about 18 to 20 ml/min. during operation. This is designated Procedure 5B.

The color paper strips treated according to Procedures 5A and 5B were stored under high-temperature high-humidity conditions (60° C., RH 70%) and examined for discoloration, fading, stain or residual color generation, reticulation, and sticking. Procedure 5A afforded equivalent properties to Procedure 5B although the amount of wash water is reduced about 25% according to Procedure 5A.

These results demonstrate the effectiveness of the fifth form of the invention.

Obviously many variations and modifications of the present invention are possible in the light of the above teachings. It is therefore to be understood that within the scope of the appended claims, the invention may be practiced otherwise than as specifically described.

We claim:

1. Apparatus for processing a photosensitive material, comprising:

a processing tank defining a plurality of compartments serially connected through narrow channels to provide a continuous processing path, means for supplying a processing solution to the path such that the path is filled with the solution, and means for passing the photosensitive material through the path whereby the photosensitive material is processed with the solution, characterized in that the first compartment to which the processing solution is first supplied has a smaller volume than the remaining compartments.

2. Apparatus for processing a photosensitive material, comprising:

a processing tank defining a plurality of compartments serially connected through narrow channels to provide a continuous processing path, means for supplying a processing solution to the path such that the path is filled with the solution, and means for passing the photosensitive material through the path whereby the photosensitive material is processed with the solution, characterized in that the first compartment to which the processing solution is first supplied is substantially emptied of the processing solution during a quiescent period.

3. The apparatus of claim 2 wherein said first compartment has a smaller volume than the remaining compartments.

4. Apparatus for processing a photosensitive material, comprising:

a processing tank defining a plurality of compartments serially connected through narrow channels to provide a continuous processing path, means for supplying wash water to the path such that the path is filled with the wash water, and means for passing the photosensitive material through the path while the photosensitive material is washed, characterized in that the apparatus further comprises a sump in fluid communication with a lower compartment which is located at a vertically lower position of the continuous processing path, and means for restraining the fluid communication between said sump and said lower compartment during processing, but allowing the fluid communication between said sump and said lower compartment at the end of processing such that the wash water is drained from said path to said sump.

5. The apparatus of claim 4 wherein the first compartment to which wash water is first supplied has a smaller volume than the remaining compartments.

6. The apparatus of claim 4 or 5 wherein the first compartment to which wash water is first supplied is substantially emptied of the wash water during a quiescent period.

7. Apparatus for processing a photosensitive material, comprising:

a processing tank defining a plurality of compartments serially connected through narrow channels to provide a continuous processing path, means for supplying wash water to the path such that the path is filled with the wash water, and means for passing the photosensitive material through the path while the photosensitive material is washed, the wash water passing in a counter flow with respect to the travel direction of the photosensitive material, characterized in that the apparatus further comprises separator means for taking an exhausted portion of the wash water out of the continuous processing path, separating the water into dilute and concentrate portions, and feeding at least the dilute portion back to the path to join the counter flow of wash water.

8. The apparatus of claim 7 wherein the first compartment to which wash water is first supplied has a smaller volume than the remaining compartments.

9. The apparatus of claim 7 or 8 wherein the first compartment to which wash water is first supplied is substantially emptied of the processing solution during a quiescent period.

10. The apparatus of claim 7 or 8 which further comprises a sump in fluid communication with a lower compartment which is located at a vertically lower position of the continuous processing path, and means for restraining the fluid communication between said sump and said lower compartment during processing, but allowing the fluid communication between said sump and said lower compartment at the end of processing such that the wash water is drained from said path to said sump.

11. The apparatus of claim 10 wherein the first compartment to which wash water is first supplied is substantially emptied of the wash water during a quiescent period.

12. In an apparatus for processing a photosensitive material, comprising:

a processing tank defining a plurality of compartments serially connected through narrow channels to provide a continuous processing path, means for supplying a processing solution to the path such that the path is filled with the solution, and means for passing the photosensitive material through the path whereby the photosensitive material is processed with the solution, characterized in that the apparatus further comprises means for delivering bubbles of an inert gas to the photosensitive material in a counter flow with respect to the travel direction of the photosensitive material, said gas being inert to the processing solution.

13. The apparatus of claim 12 wherein the first compartment to which the processing solution is first supplied has a smaller volume than the remaining compartments.

14. The apparatus of claim 12 or 13 wherein the first compartment to which the processing solution is first supplied is substantially emptied of the processing solution during a quiescent period.

15. The apparatus of claim 12 wherein the processing solution is wash water, said apparatus further comprising:

a sump in fluid communication with a lower compartment which is located at a vertically lower position of the continuous processing path, and means for restraining the fluid communication between said sump and said lower compartment during processing, but allowing the fluid communication between said sump and said lower compartment at the end of processing such that the wash water is drained from said path to said sump.

16. The apparatus of claim 15 wherein the first compartment to which wash water is first supplied has a smaller volume than the remaining compartments.

17. The apparatus of claim 15 or 16 wherein the first compartment to which wash water is first supplied is substantially emptied of the wash water during a quiescent period.

18. The apparatus of claim 12 wherein the processing solution is wash water, said apparatus further comprising:

separator means for taking an exhausted portion of the wash water out of the continuous processing path, separating the water into dilute and concentrate portions, and feeding the dilute portion back to the path.

19. The apparatus of claim 18 wherein the first compartment to which wash water is first supplied has a smaller volume than the remaining compartments.

20. The apparatus of claim 18 or 19 wherein the first compartment to which wash water is first supplied is substantially emptied of the wash water during a quiescent period.

21. The apparatus of claim 18 or 19 which further comprises: a sump in fluid communication with a lower compartment which is located at a vertically lower position of the continuous processing path, and means for restraining the fluid communication between said sump and said lower compartment during processing, but allowing the fluid communication between said sump and said lower compartment at the end of processing such that the wash water is drained from said path to said sump.

22. The apparatus of claim 20 which further comprises:

a sump in fluid communication with a lower compartment which is located at a vertically lower position of the continuous processing path, and means for restraining the fluid communication between said sump and said lower compartment during processing, but allowing the fluid communication between said sump and said lower compartment at the end of processing such that the wash water is drained from said path to said sump.

* * * * *